US008069520B2

(12) United States Patent
Mattucci et al.

(10) Patent No.: US 8,069,520 B2
(45) Date of Patent: Dec. 6, 2011

(54) POWER MOP WITH EXPOSABLE SCRUB BRUSH

(75) Inventors: Marco Alessandro Mattucci, Baltimore, MD (US); Joe Rogers, Jarrettsville, MD (US); Christopher John Murray, Baltimore, MD (US); Mark Slobodian, Ottawa (CA); Patrick Marcil, Ottawa (CA)

(73) Assignee: Black & Decker, Towson, MD (US)

( * ) Notice: Subject to any disclaimer, the term of this patent is extended or adjusted under 35 U.S.C. 154(b) by 1269 days.

(21) Appl. No.: 11/703,761

(22) Filed: Feb. 8, 2007

(65) Prior Publication Data

US 2007/0214586 A1 Sep. 20, 2007

Related U.S. Application Data

(60) Provisional application No. 60/772,577, filed on Feb. 13, 2006.

(51) Int. Cl.
*A47L 11/162* (2006.01)
*A47L 11/282* (2006.01)

(52) U.S. Cl. ..... 15/4; 15/22.1; 15/49.1; 15/50.1; 15/98

(58) Field of Classification Search ..... 15/4, 22.1, 15/49.1, 50.1, 98, 115, 116.1, 116.2
See application file for complete search history.

(56) References Cited

U.S. PATENT DOCUMENTS

| | | | | |
|---|---|---|---|---|
| 817,766 | A | 4/1906 | Hames | |
| 871,246 | A * | 11/1907 | Thomas | 15/116.1 |
| 1,059,427 | A * | 4/1913 | Barnwell | 401/13 |
| 1,065,975 | A * | 7/1913 | Shaw | 401/27 |
| 1,383,731 | A * | 7/1921 | Leigh | 15/147.1 |
| 1,391,111 | A * | 9/1921 | Hill | 15/116.1 |
| 1,563,829 | A | 12/1925 | Brown | |
| 2,127,886 | A | 8/1938 | Plon | |
| 2,896,235 | A | 7/1959 | Clements | |
| 3,013,288 | A | 12/1961 | Lappin | |
| 3,099,855 | A | 8/1963 | Nash | |
| 3,115,656 | A | 12/1963 | McKinstry | |
| 3,167,798 | A * | 2/1965 | Dryden | 15/115 |
| 3,210,792 | A | 10/1965 | Sassano, Sr. | |
| 3,737,938 | A | 6/1973 | Saltzstein | |
| 3,792,505 | A | 2/1974 | Saltzstein | |
| 3,833,962 | A | 9/1974 | Krusche | |
| 3,981,106 | A | 9/1976 | Gallo | |

(Continued)

FOREIGN PATENT DOCUMENTS

AU 2004204801 A1 7/2004

(Continued)

*Primary Examiner* — Randall Chin
(74) *Attorney, Agent, or Firm* — Kramer & Amado P.C.

(57) ABSTRACT

A cleaning tool including one or more of the following features in various embodiments: a mop head that pivots with respect to a handle assembly to dispose a motorized power head between a mopping position and a scrubbing position; a nozzle assembly connected to the handle assembly and in fluid communication with a liquid reservoir, the liquid disposed within the liquid reservoir ejected from the nozzle assembly in response to trigger control by an operator; an absorbent or soil attracting mopping cloth attached to a cartridge support; a mopping cartridge ejection member slidably disposed within the mopping platform and manipulated to eject the mopping cartridge from the mopping platform; and a mopping cloth ejection member disposed on a top surface of the mopping platform and manipulated to eject the mopping cloth from the mopping platform.

12 Claims, 23 Drawing Sheets

U.S. PATENT DOCUMENTS

| | | | |
|---|---|---|---|
| 4,491,998 | A | 1/1985 | Wilson et al. |
| 4,731,897 | A | 3/1988 | Griffin |
| 4,802,782 | A | 2/1989 | Scalf |
| 4,885,876 | A | 12/1989 | Henke |
| 5,071,489 | A | 12/1991 | Silvenis et al. |
| 5,243,729 | A | 9/1993 | Tomm |
| 5,371,917 | A | 12/1994 | Hoagland |
| 5,461,749 | A | 10/1995 | Ahlberg et al. |
| 5,483,720 | A | 1/1996 | Decoopman et al. |
| 5,488,750 | A | 2/1996 | Vosbikian et al. |
| 5,542,352 | A | 8/1996 | Blackman et al. |
| 5,655,248 | A | 8/1997 | Kieson et al. |
| 5,701,630 | A | 12/1997 | Liao |
| 5,787,586 | A | 8/1998 | Apprille, Jr. et al. |
| 5,836,039 | A | 11/1998 | Rimer |
| 5,924,167 | A | 7/1999 | Wright et al. |
| 5,933,913 | A | 8/1999 | Wright et al. |
| 5,978,999 | A | 11/1999 | deBlois et al. |
| 5,983,448 | A | 11/1999 | Wright et al. |
| 6,000,088 | A | 12/1999 | Wright et al. |
| 6,026,530 | A | 2/2000 | Camp, Jr. |
| 6,065,182 | A | 5/2000 | Wright et al. |
| 6,101,671 | A | 8/2000 | Wright et al. |
| 6,216,307 | B1 | 4/2001 | Kaleta et al. |
| 6,237,232 | B1 | 5/2001 | Petricca et al. |
| 6,305,042 | B1 | 10/2001 | Lalli |
| 6,305,046 | B1 | 10/2001 | Kingry et al. |
| 6,421,869 | B1 | 7/2002 | Olsson |
| D462,150 | S | 8/2002 | Rader et al. |
| 6,446,299 | B1 | 9/2002 | Kaleta |
| 6,484,346 | B2 | 11/2002 | Kingry et al. |
| 6,540,424 | B1 | 4/2003 | Hall et al. |
| 6,588,045 | B2 | 7/2003 | Fernandez |
| 6,591,442 | B2 | 7/2003 | Kaminstein |
| 6,611,986 | B1 | 9/2003 | Seals |
| 6,651,290 | B2 | 11/2003 | Kingry et al. |
| 6,659,670 | B1 | 12/2003 | Blouse |
| D487,173 | S | 2/2004 | Clare et al. |
| 6,842,936 | B2 | 1/2005 | Policicchio et al. |
| 6,871,372 | B2 | 3/2005 | Vosbikian et al. |
| 6,892,415 | B2 | 5/2005 | Libman et al. |
| 6,964,535 | B2 | 11/2005 | Bell et al. |
| 7,264,413 | B2 * | 9/2007 | Vosbikian et al. ..... 401/139 |
| 7,636,979 | B1 | 12/2009 | Morad |
| 2002/0026680 | A1 | 3/2002 | Kingry et al. |
| 2002/0120993 | A1 | 9/2002 | Busha |
| 2002/0120996 | A1 | 9/2002 | Kaminstein |
| 2002/0184726 | A1 | 12/2002 | Kingry et al. |
| 2003/0009839 | A1 | 1/2003 | Streutker et al. |
| 2003/0028988 | A1 | 2/2003 | Streutker et al. |
| 2003/0074756 | A1 | 4/2003 | Policicchio et al. |
| 2003/0205243 | A1 | 11/2003 | Fernandez |
| 2004/0011382 | A1 | 1/2004 | Kingry et al. |
| 2004/0055102 | A1 | 3/2004 | Treacy et al. |
| 2004/0068817 | A1 | 4/2004 | Policicchio |
| 2004/0071490 | A1 | 4/2004 | Vosbikian et al. |
| 2004/0074520 | A1 | 4/2004 | Truong et al. |
| 2004/0187240 | A1 | 9/2004 | Berti et al. |
| 2004/0237228 | A1 | 12/2004 | King et al. |
| 2004/0244133 | A1 | 12/2004 | Li |
| 2005/0011536 | A1 | 1/2005 | Hofte et al. |
| 2005/0039286 | A1 | 2/2005 | Brinker et al. |
| 2005/0060827 | A1 | 3/2005 | James et al. |
| 2006/0277704 | A1 * | 12/2006 | Pineschi ..... 15/105 |
| 2007/0136963 | A1 | 6/2007 | Vosbikian |

FOREIGN PATENT DOCUMENTS

| | | | |
|---|---|---|---|
| AU | 2010200235 | A1 | 2/2010 |
| CA | 2493334 | A1 | 7/2004 |
| CA | 2634126 | A1 | 7/2007 |
| CN | 1717192 | A | 1/2006 |
| GB | 2414384 | A | 11/2005 |
| GB | 2422298 | A | 7/2006 |
| GB | 2424175 | A | 9/2006 |
| HK | 1088799 | A1 | 2/2007 |
| HK | 1089066 | A1 | 6/2007 |
| WO | 2004/062456 | A2 | 7/2004 |
| WO | 2007076305 | A2 | 7/2007 |

* cited by examiner

FIG. 18
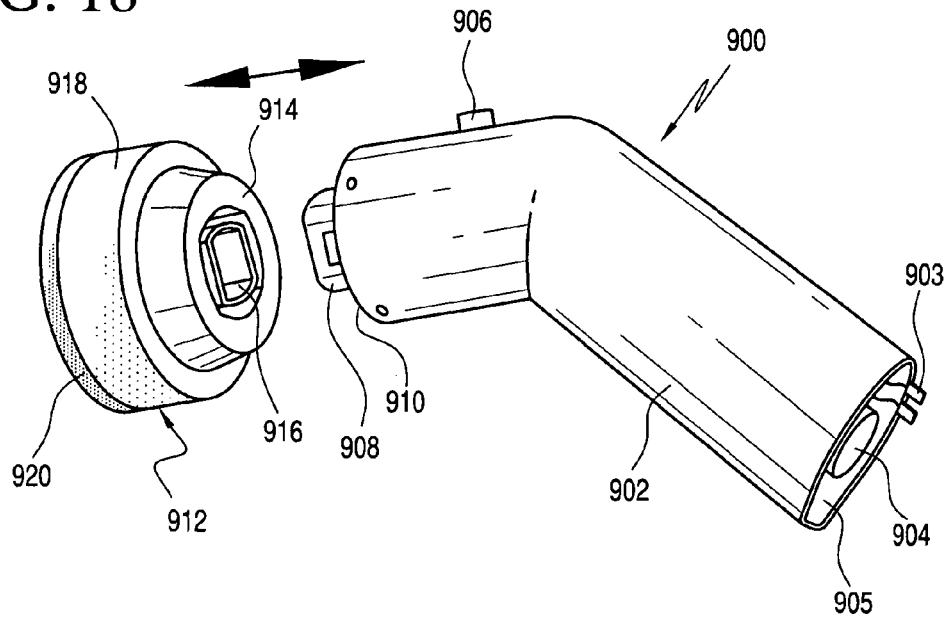
FIG. 19
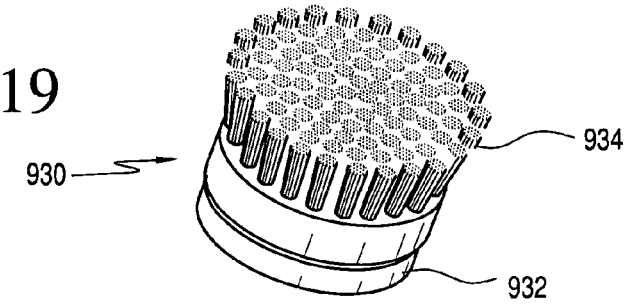
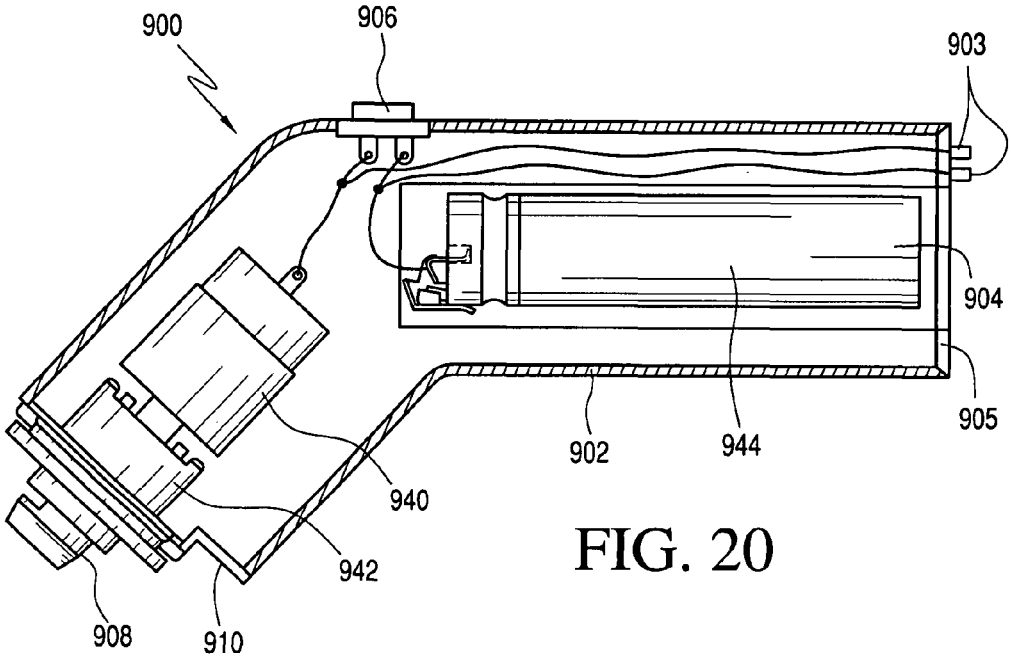
FIG. 20

FIG. 34
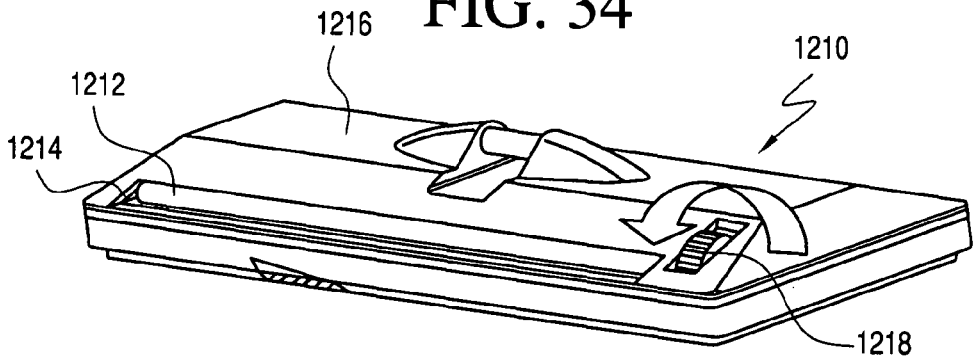
FIG. 35
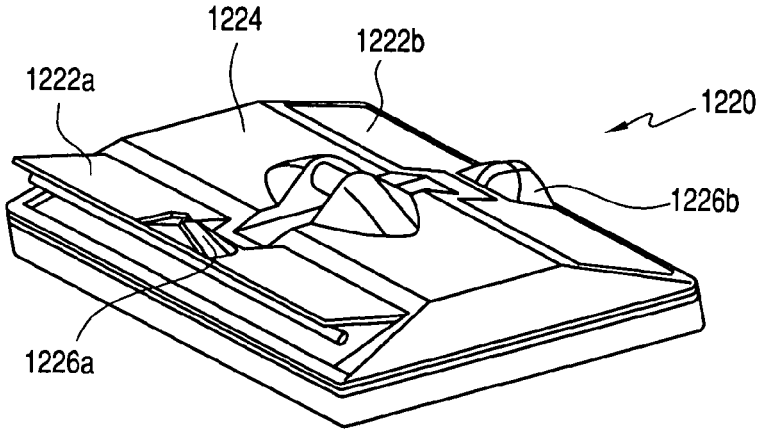
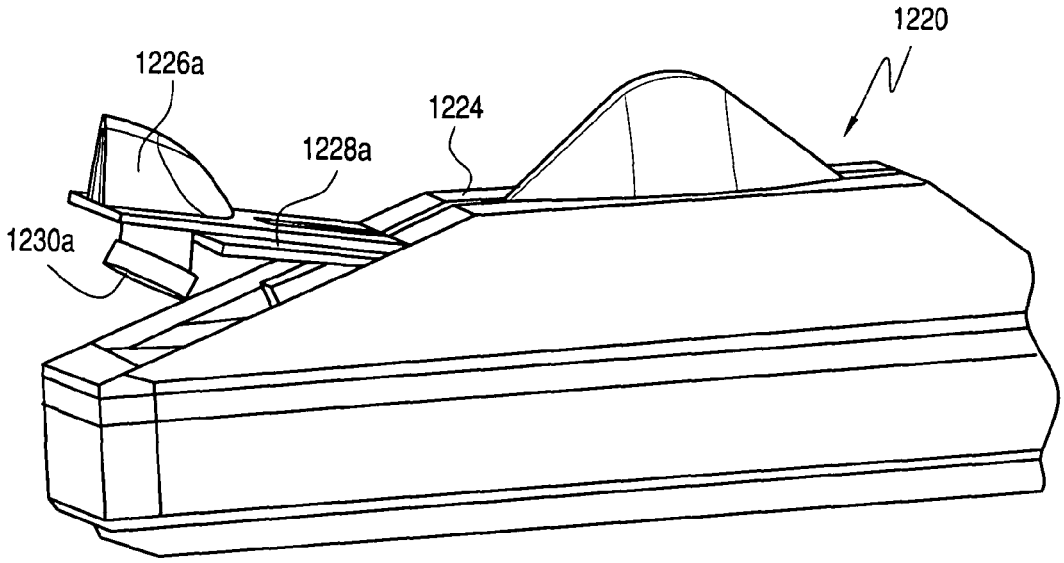
FIG. 36

POWER MOP WITH EXPOSABLE SCRUB BRUSH

FIELD OF THE INVENTION

The present invention relates to powered cleaning tools. More particularly, the present invention relates to powered cleaning tools with powered agitators and changeable cleaning elements.

BACKGROUND OF THE INVENTION

The act of mopping is a conventional way to clean hard, generally flat surfaces such as floors, counters, and boat decking. There are generally three types of mopping, conventionally known as wet mopping, damp mopping, and dry mopping. In conventional wet mopping, a handled absorbent mopping tool is dipped into a liquid container. The liquid is generally water based, and may contain an additive such as detergent, solvent, or other compound such as wax. One purpose of the additive is to break down and dissolve dirt or soil. Another purpose of the additive is to attract the dirt or soil to the absorbent material in order to clean the surface. The absorbent material is conventionally a sponge or series of woven strands that are used to convey the liquid onto the cleaning surface. During application of the liquid, the absorbent material is manually scrubbed against the cleaning surface in order to dislodge and absorb the dirt or soil. The absorbent material is then conventionally rung in the liquid container, such as a bucket or other receptacle, to dislodge the dirty water. This process is conventionally repeated until the surface is clean.

One form of damp mopping is to apply a nearly dry mop to a wet surface in order to absorb liquid therefrom. This form of damp mopping conventionally follows wet mopping in order to fully absorb liquid from the cleaning surface. Another form of damp mopping is to scrub a dirty surface with a damp, i.e. semi-moist, absorbent material. This form of damp mopping is used in an effort to avoid the mess associated with wet mopping. In yet another form of damp mopping, a small amount of liquid is externally applied to a surface, such as from a hand held spray bottle, with the surface being cleaned by an absorbent mop. Dry mopping is another form of mopping where a dry mop is used to absorb or attract dirt without the use of liquid. In this case, the mop head may be treated with a chemical in order to statically attract dirt, soil and dust from the cleaning surface. While wet mopping and some forms of damp mopping generally require the use of a bucket or other liquid receptacle, dry mopping and other forms of damp mopping do not.

During repeated application of the mopping process, the absorbent material is generally subject to wear and eventually becomes unusable. In addition, the absorbent material may itself become permanently soiled or stained, and thereby present an unsanitary condition to the user. The repeated manual scrubbing of the surface being cleaned subjects the operator to fatigue and thereby limits the total surface area that may be cleaned in a single cleaning application. While some types of industrial cleaning machines provide options for wet and damp mopping, these types of machines suffer from a lack of portability and are generally ineffective around closely placed articles, such as in a household environment.

Wet mopping, damp mopping, and dry mopping readily lend themselves to application by a traditional mop having a compressible, wringable, mop head. In one form, the traditional mop head is comprised of a plurality of natural or synthetic woven strands that are generally tied together and joined with a handle. The wringable mop head is traditionally placed into a bucket or sink having an attached wringer for discharge of liquid from the mop head. A lever on the wringer is manually manipulated to compress the mop head with a paddle or a pair of paddles. Each paddle is traditionally provided with a plurality of holes to enhance egress of liquid from the mop head. In another form, the traditional mop head includes an integrated wringer. The integrated wringable mop head traditionally includes a spongiform material that is buttressed by a compression mechanism, such as a pair of rollers. By way of mechanical action, the rollers are manipulated about alternate sides of the spongiform material to discharge liquid from the mop head. The traditional wringable mop heads are generally prone to mess during discharge of the liquid therefrom.

Accordingly, there is a need for a portable cleaning tool with a non-wringable mop head for wet, damp, and dry mopping. There is a further need for a portable cleaning tool that provides a powered scrubbing operation while addressing the wear associated with the absorbent or dirt attracting mop head material.

SUMMARY OF THE INVENTION

A convenient new powered cleaning instrument has been developed for cleaning generally flat surfaces such as floors, countertops, and the like. In one preferred form, the present invention provides a cleaning tool including a non-wringable mop head pivotally connected to a handle assembly. The handle assembly includes an extension member connected to a power head, with the power head inducing agitation in an attached scrub head. The power head has a housing enclosing motor and battery to induce rotatable agitation in the scrub head. A nozzle assembly is connected to the handle assembly and is in fluid communication with a liquid reservoir. The liquid disposed within the liquid reservoir is ejected from the nozzle assembly in response to trigger control by an operator. The liquid reservoir is removably retained within a caddy or cradle that is attached to or formed continuously with the extension member. A fluid line connects the nozzle assembly to the liquid reservoir, and is fully or partially disposed within the extension member. Alternately, the fluid line is disposed on an outer surface of the handle assembly. The mop head pivots with respect to the handle assembly to position the scrub head in position for a scrubbing operation. The mop head further pivots with respect to the handle assembly to maintain operator control of the cleaning tool during a mopping operation. A pivot handle is connected to the mop head and is manipulated to pivot the mop head, thereby exposing the scrub head.

In another preferred form the present invention provides a cleaning tool comprising a handle assembly, a nozzle assembly, and a non-wringable mop head. The handle assembly includes an extension member connected to a motorized power head to induce agitation in an attached scrub head. The nozzle assembly is connected to the handle assembly and is in fluid communication with a liquid reservoir. Liquid disposed within the liquid reservoir is ejected from the nozzle assembly in response to trigger control by an operator. The non-wringable mop head pivotally connects to the handle assembly and pivotally retracts with respect to the power head to thereby dispose the scrub head in a scrubbing, i.e. cleaning, position. A pivot handle is connected to the mop head and is manipulated to retract the mop head with respect to the power head. The mop head is optionally configured with a mopping platform to securably retain a mopping cloth with a plurality of mopping cloth attachment sections. The mop head is optionally configured with a mopping platform to removably engage a mop cartridge. The mop cartridge has an absorbent or soil attracting mopping cloth attached to a cartridge support, and is optionally disposable. A pair of ejection members is slidably disposed within the mopping platform such that each of the ejection members may be manipulated to eject the mopping cartridge from the mopping platform. The mopping platform may be configured to removably retain a mopping cloth or a mopping cartridge.

Further areas of applicability of the present invention will become apparent from the detailed description provided hereinafter. It should be understood that the detailed description and specific examples, while indicating the preferred embodiments and best mode of the invention, are intended for purposes of illustration only and are not intended to limit the scope of the invention. Further, the following description and accompanying drawings provide multiple features and embodiments that are usable together, but may be shown separately to avoid prolixity and facilitate ease of understanding.

BRIEF DESCRIPTION OF THE DRAWINGS

Additional advantages and features of the present invention will become apparent from the subsequent description and the appended claims, taken in conjunction with the accompanying drawings, wherein:

FIG. 18 is a perspective view of a power head for use with a cleaning tool according to an embodiment of the present invention;

FIG. 19 a perspective view of a bristled scrub head for use with the power head of FIG. 18;

FIG. 20 a side sectional view of the power head of FIG. 18;

FIG. 34 is an elevated perspective view of a mopping platform according to another alternate embodiment of the present invention;

FIGS. 35 and 36 are elevated perspective views of a mopping platform according to yet another alternate embodiment of the present invention;

DETAILED DESCRIPTION OF THE PREFERRED EMBODIMENTS

Figure 2:
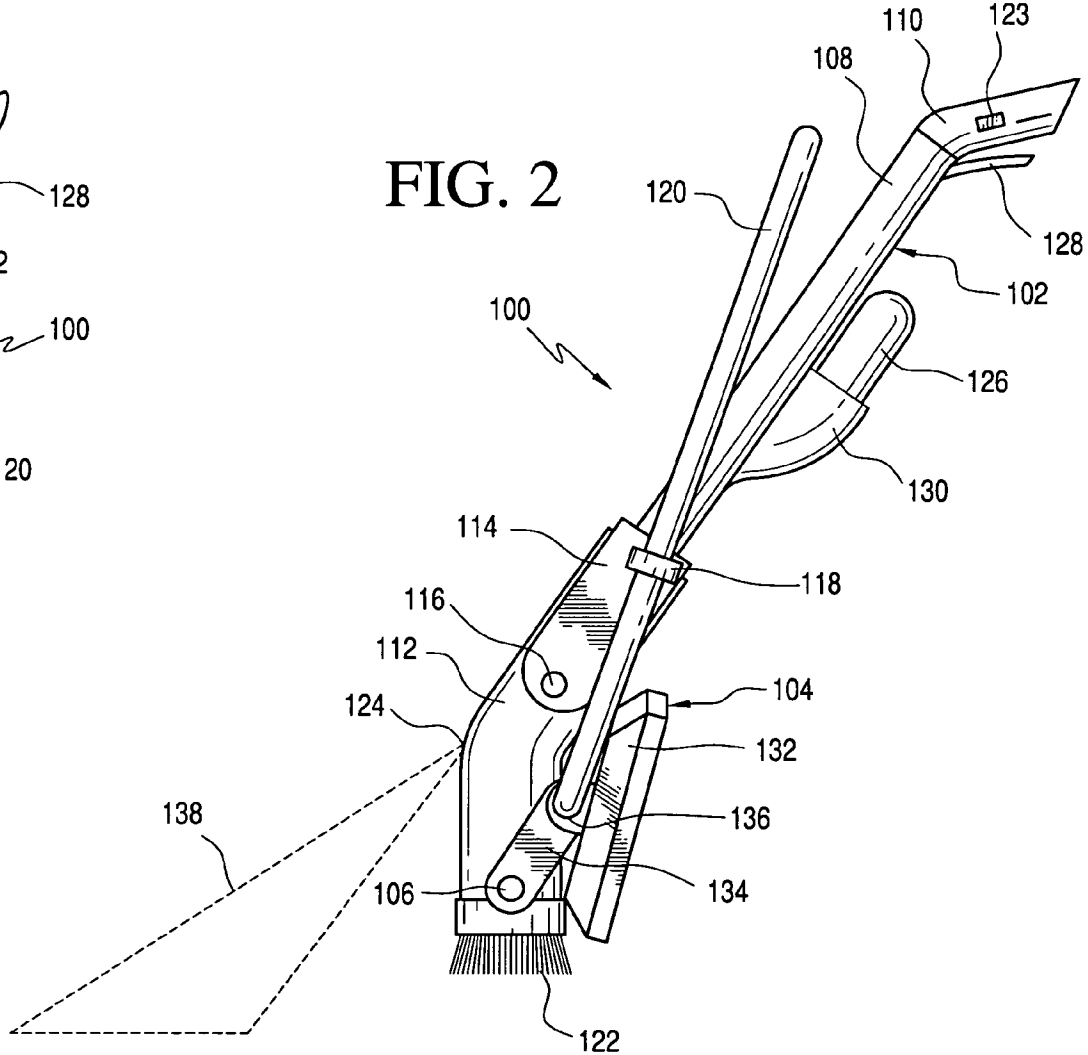
FIG. 2 is a side view of the cleaning tool of FIG. 1 illustrating a scrubbing operation and a spraying operation.
Figure 1:
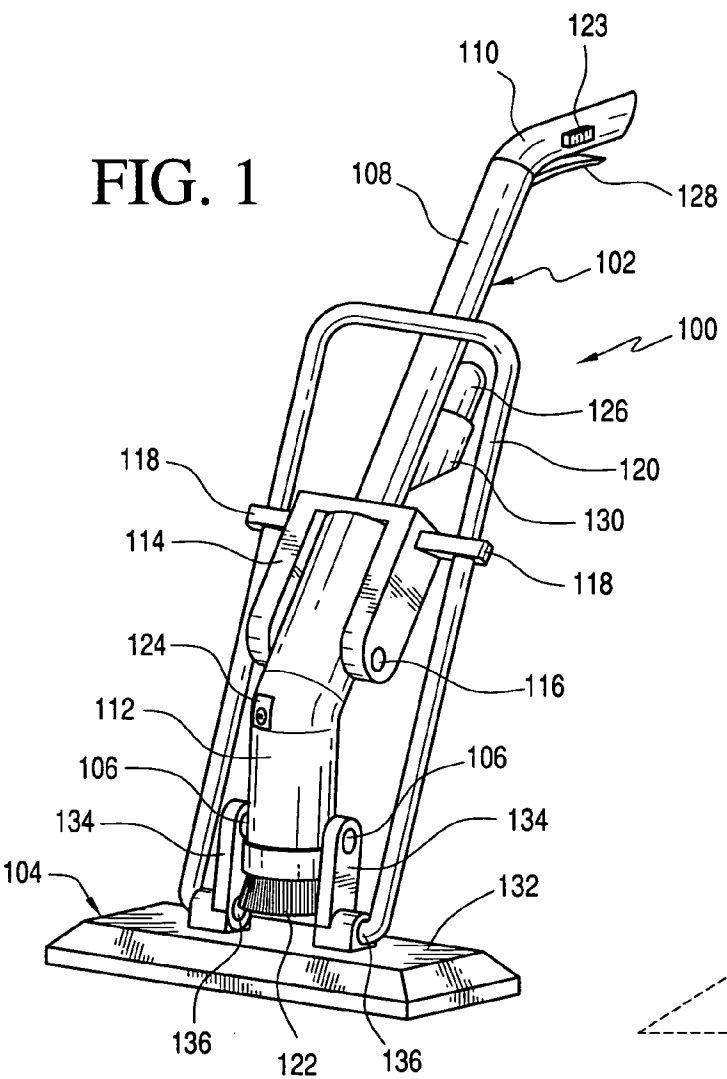
FIG. 1 is an elevated perspective view of a cleaning tool illustrating a mopping operation according to an embodiment of the present invention.

With reference now to the figures, cleaning tool 100 is illustrated in a mopping position in FIG. 1 and in a scrubbing position in FIG. 2, according to an embodiment of the present invention. Cleaning tool 100 comprises a handle assembly 102 connected to mop head 104. According to the illustrated embodiment, handle assembly 102 pivots with respect to mop head 104 about pivot joints 106. The act of pivoting about joints 106 enhances portability of cleaning tool 100 and permits mop head 104 to reach underneath closely placed objects, such as household tables and chairs, while maintaining operator control.

Handle assembly 102 includes extension member 108 terminating at a proximal end in handle grip 110 and terminating at a distal end in power head 112. Extension member 108 is statically attached to power head 112 by way of collar member 114. According to a preferred embodiment, extension member 108 is formed from a plurality of connectable sections to facilitate packaging, storage, and portability. Alternatively, extension member 108 is a single section elongated boom. According to the illustrated embodiment, collar member 114 is a U-shaped member disposed about power head 112, and is attached thereto by way of attachment pins 116. Collar member 114 includes a pair of guide flanges 118 for engaging and slidably retaining pivot handle 120. The operation of pivot handle 120 is discussed in greater detail below.

Power head 112 provides support to scrub head 122. According to an embodiment, scrub head 122 is statically attached to power head 112. According to a preferred embodiment, power head 112 includes a powered motor assembly (not shown) to selectably engage and induce agitation in scrub head 122 by way of activation switch 123 in handle grip 110. Alternately, activation switch 123 may be provided on power head 112 or may be a sensor that responds to conversion from the mopping position of FIG. 1 to the scrubbing position of FIG. 2. Pivot handle 120 is used to change cleaning tool 100 between the mopping position and the scrubbing position. According to a preferred embodiment, power head 112 rotatably engages scrub head 122 during a scrubbing operation, set forth in greater detail below. According to a preferred embodiment, the powered motor assembly is powered by batteries, such as alkaline batteries or rechargeable batteries (not shown). Alternately, the powered motor assembly is powered through an electrical connection to conventional household power.

Power head 112 further includes a nozzle assembly 124 that is in fluid communication with liquid reservoir 126 by way of an internal fluid line (not shown). When the operator activates spray switch 128 in handle grip 110, liquid is released from liquid reservoir 126 and out through spray nozzle assembly 124. According to a preferred embodiment, liquid reservoir 126 is a removable bottle that is held in cradle 130 attached to extension member 108. According to an alternate embodiment, liquid reservoir 126 is a cartridge that may be filled from an external liquid source (not shown).

Mop head 104 includes a mopping platform 132 that is configured to engage an absorbent or soil attracting mopping material, discussed in greater detail below. Mopping platform 132 is supported by a pair of platform extensions 134 connected to a top surface thereof. The platform extensions 134 are rotatably connected to power head 112 by way of pivot joints 106. The platform extensions 134 are further connected to distal ends of pivot handle 120 by way of pivot joints 136.

FIG. 2 is a side view of the cleaning tool 100 illustrated in FIG. 1 transformed from the mopping position of FIG. 1 into a scrubbing position. In order to transform into the scrubbing position, pivot handle 120 is pulled proximally toward the operator in order to pivot mopping platform 132 with respect to handle assembly 102. Pivot handle 120 is pulled linearly within guide flanges 118, which causes platform extensions 134 to pivot about pivot joints 106. Pivot handle 120 also rotates about pivot joints 136 such that mopping platform 132 is nearly flush with the back side of power head 112, thereby exposing scrub head 122 in a position for cleaning a cleaning surface. Upon activation of activation switch 123, power head 112 is energized to induce agitation in scrub head 122. Preferably, scrub head 122 rotates to provide the agitation to the cleaning surface.

FIG. 2 further illustrates cleaning tool 100 during a spraying operation. The spraying operation may be optionally executed when cleaning tool 100 is in the mopping position or in the scrubbing position. Upon activation of spray switch 128, a liquid flow 138 is ejected from nozzle assembly 124. According to an embodiment, nozzle assembly 124 provides a fixed stream onto the cleaning surface. According to an alternate embodiment, nozzle assembly 124 is optionally adjustable to control liquid flow 138 between a stream of liquid and an atomized spray. According to an embodiment, spray switch 128 is a pump switch under manual control of an operator to induce a pumping ejection of liquid flow 138. According to another embodiment, spray switch 128 is an electrical switch in communication with a motorized pump to control ejection of the liquid flow from nozzle assembly 124.

Figure 3:
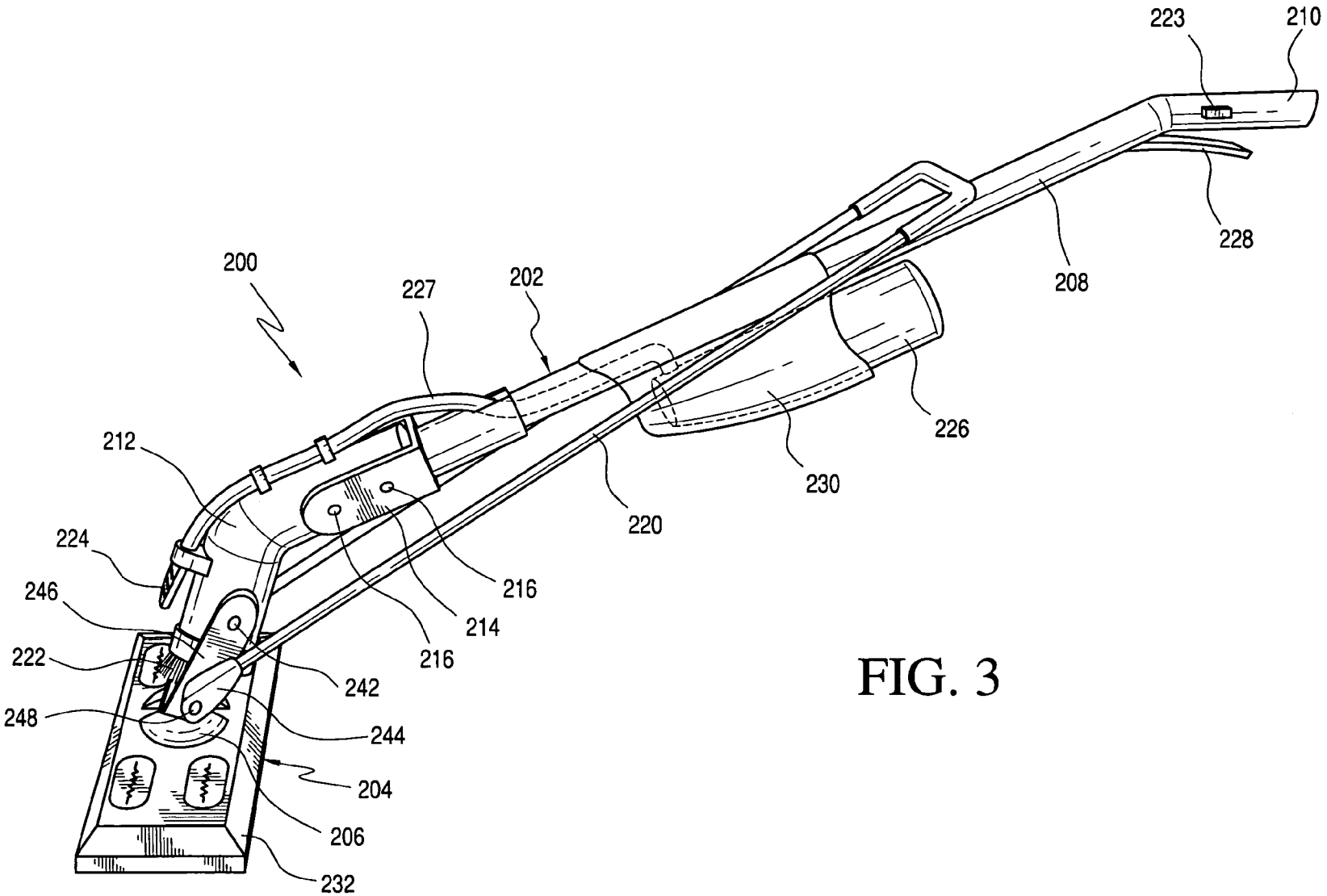
FIG. 3 is a side view of a cleaning tool in a mopping position according to an embodiment of the present invention.

FIG. 3 is a side view of a cleaning tool 200 in a mopping position according to an embodiment of the present invention. Cleaning tool 200 comprises a handle assembly 202 and a pivot handle 220 connected to mop head 204. According to the illustrated embodiment, handle assembly 202 laterally pivots with respect to mop head 204 about lateral pivot joint 206. The act of pivoting about joint 206 enhances portability of cleaning tool 200 and permits mop head 204 to reach underneath household structures, such as tables and chairs, while maintaining operator control.

Handle assembly 202 includes extension member 208 terminating at a proximal end in handle grip 210 and terminating at a distal end in power head 212. Extension member 208 is statically attached to power head 212 by way of collar member 214. The collar member 214 may be formed integrally with extension member 208 or may be attached thereto. According to the illustrated embodiment, collar member 214 is a U-shaped member disposed about power head 212, and is attached thereto by way of attachment pins 216.

Power head 212 provides support to scrub head 222. According to an embodiment, scrub head 222 is statically attached to power head 212. According to a preferred embodiment, power head 212 includes a powered motor assembly (not shown) to selectably engage and induce agitation in scrub head 222 by way of activation switch 223 in handle grip 210. Alternately, activation switch 223 may be provided on power head 212 or may be a sensor that responds to conversion from the mopping position of FIG. 3 to the scrubbing position of FIG. 4, discussed in greater detail below. Activation switch 223 may optionally be a sensor that responds to movement of pivot handle 220 during conversion of cleaning tool 200 from the mopping position into the scrubbing position. Power head 212 preferably includes a motor assembly powered by batteries, such as alkaline or rechargeable batteries (not shown). Alternately, the powered motor assembly is powered through an electrical connection to conventional household power.

Power head 212 further includes an external nozzle assembly 224 that is in fluid communication with liquid reservoir 226 by way of fluid line 227. As illustrated, fluid line 227 is partially received within extension member 208 and maintains fluid connection between nozzle assembly 224 and fluid reservoir 226. According to an alternate embodiment, fluid line 227 is completely disposed within extension member 208 and nozzle assembly 224 is integrally molded with the housing of the power head 212. When the operator activates spray switch 228 in handle grip 210, liquid is released from liquid reservoir 226 and out through external nozzle assembly 224. According to a preferred embodiment, liquid reservoir 226 is a removable bottle that is held in cradle 230 attached to extension member 208. According to another embodiment, cradle 230 is integrally molded with extension member 208 and fluid line 227 is disposed within cradle 230 and extension member 208 for connection to nozzle assembly 224. According to an alternate embodiment, liquid reservoir 226 is a cartridge that may be optionally disposed within extension member 208 itself and filled from an external liquid source (not shown). According to yet another alternate embodiment, liquid reservoir 226 is an elongated bottle that is partially or fully received within the structure of extension member 208, thereby eliminating the need for cradle 230.

Power head 212 is connected to mop head 204 by way of lateral pivot joint 206. In particular, power head 212 is connected to collar member 246, which in turn connects to lateral pivot joint 206. As illustrated, collar member 246 is a U-shaped member that is disposed around power head 212 and pivotally connected to power head 212 by way of pivot joints 242. Pivot handle 220 is preferably U-shaped and is connected at distal ends to receiving sections 244. The receiving sections 244 are disposed about opposite sides of collar member 246, and are pivotally connected about pivot joints 248. According to an alternate embodiment, pivot handle 220 is a single extended arm that is distally connected to mop head 204 and proximally connected to a movable collar about extension member 208.

Mop head 204 includes a mopping platform 232 that is configured to engage an absorbent or soil attracting mopping material that is suitable for wet mopping, damp mopping, and/or dry mopping, discussed in greater detail below. Mopping platform 232 is connected at a top surface thereof to handle assembly 202 by way of lateral pivot joint 206. More particularly, mopping platform 232 is connected to collar member 246, which is connected to power head 212, which in turn is connected to extension member 208.

Figure 4:
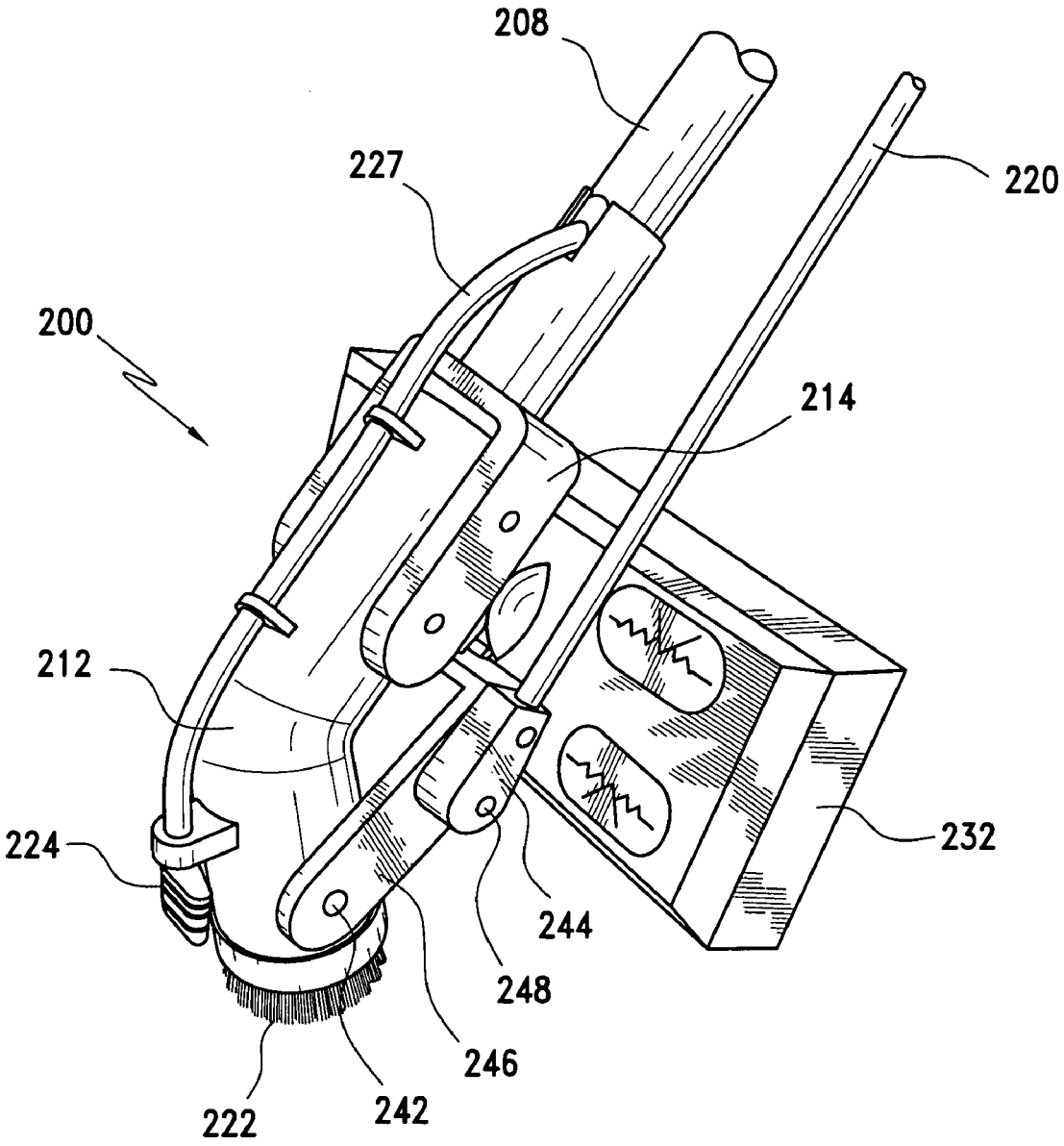
FIG. 4 is a perspective view of a mop head of the cleaning tool of FIG. 3 in a scrubbing position.

FIG. 4 is a perspective view of the mop head 204 of the cleaning tool 200 of FIG. 3 during a scrubbing operation. In order to transform from the mopping position into the scrubbing position of FIG. 4, pivot handle 220 is pulled proximally toward the operator in order to pivot mopping platform 232 with respect to handle assembly 202. Pivot handle 220 is pulled linearly toward handle grip 210, which causes receiving sections 244 to pivot about pivot joints 248. Additionally, power head 212 rotates about pivot joints 242 with respect to collar member 246 to thereby expose scrub head 222 for cleaning. When pivot handle 220 is fully pulled toward handle grip 210, mopping platform 232 is nearly flush with the back side of power head 212, thereby exposing scrub head 222 in a position for cleaning a cleaning surface. Upon activation of activation switch 223, power head 212 is energized to induce agitation in scrub head 222. Preferably, scrub head 222 rotates to provide agitation to the cleaning surface.

Cleaning tool 200 may be used during a spraying operation in the mopping position of FIG. 3 or in the scrubbing position of FIG. 4, set forth in greater detail below. Upon activation of spray switch 228, a uniform liquid flow is ejected from nozzle assembly 224. According to an alternate embodiment, nozzle assembly 224 is optionally adjustable to vary the liquid flow between a stream of liquid or an atomized spray. According to an embodiment, spray switch 228 is a pump switch under manual control of an operator to induce a pumping ejection of the liquid flow. According to another embodiment, spray switch 228 is an electrical switch in communication with a motorized pump to control ejection of the liquid flow from nozzle assembly 224.

Figure 5:
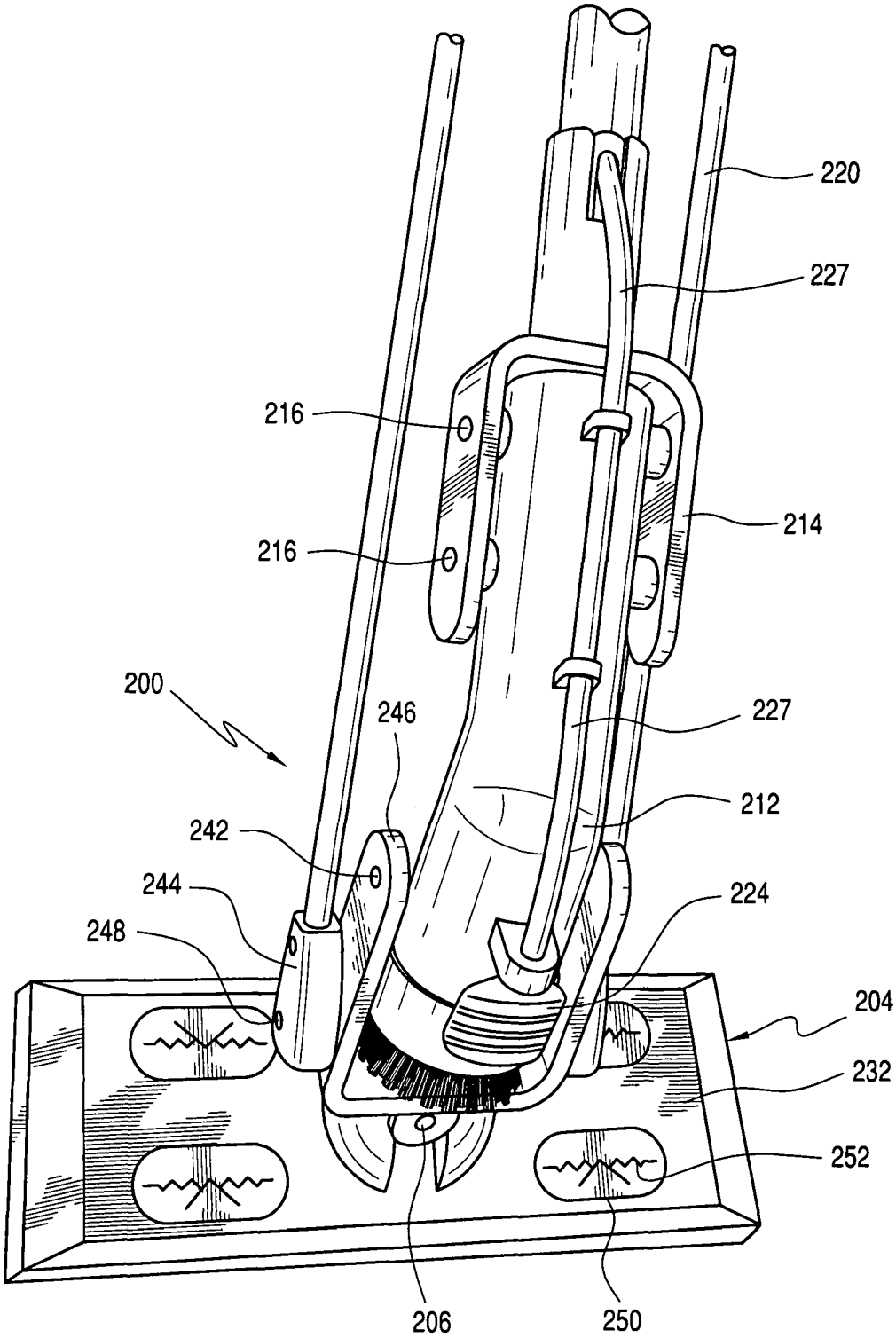
FIG. 5 is a detailed perspective view of the mop head of FIG. 4.

FIG. 5 is a detailed perspective view of mop head 204 and power head 212 of cleaning tool 200. Mopping platform 232 is generally rigid and has a flat surface on an underside thereof. A top surface of mopping platform 232 includes at least one mopping cloth attachment section 250 for securably retaining an absorbent or soil attracting mopping cloth. According to a preferred embodiment, attachment sections 250 are ovulate orifices disposed on a top surface of mopping platform 232, with each orifice 250 exposing a plurality of flexibly deformable fingers 252. As illustrated, the flexibly deformable fingers 252 form a plurality of ridges for retainably holding a mopping cloth or tissue, described in detail with regard to FIG. 6 below. The mopping cloth is wrapped about the bottom flat surface of mop head 204 and a plurality of mopping cloth extensions are insertably retained by fingers 252. According to an alternate embodiment, mopping cloth attachment sections 250 are formed from spring loaded metal or plastic alligator clips. According to another alternate embodiment, attachment sections 250 are removed and an absorbent mopping cloth material is affixed to the flat underside of mop head 204, such as by way of hook and loop type fasteners or an adhesive. According to yet another embodiment, mop head 204 is configured to engage a mopping cartridge, as set forth in greater detail below.

Figure 6:
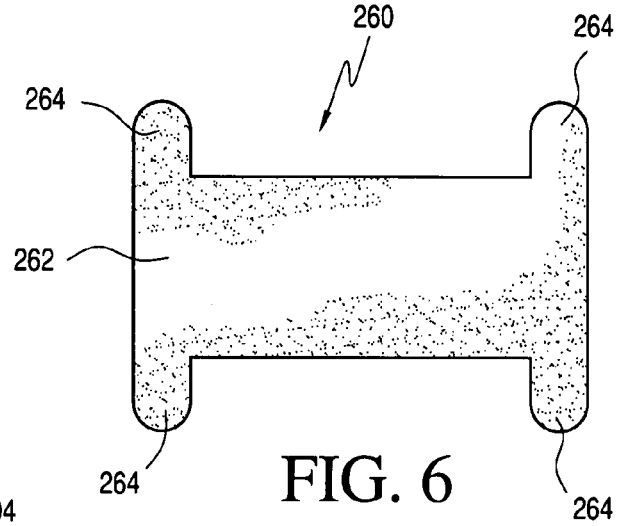
FIG. 6 is a top view of a mopping cloth for use with a mop head according to an embodiment of the present invention.

FIG. 6 is a top view of a mopping cloth 260 for use with mop head 204 according to an embodiment of the present invention. Mopping cloth 260 is generally a flexible sheet having a body portion 262 with a plurality of extension sections 264. The extension sections 264 are configured and arranged to be held by way of fingers 252 in mop head 204 of FIG. 5. Mopping cloth 260 is preferably a fabric material suitable for wet mopping, damp mopping, and/or dry mopping. Mopping cloth 260 is optionally treated with a chemical detergent or solvent for attracting dirt or soil. For dry mopping, mopping cloth 260 is preferably treated with a chemical to attract dirt or soil, such as dust, upon contact. Mopping cloth 260 is generally disposable to maintain hygienic use of cleaning tool 200. However, mopping cloth is alternatively a reusable cloth material that may be periodically cleaned by soaking or washing in a chemical solution, such as water and bleach. According to an embodiment, mopping cloth 260 does not include extension sections 264, and is generally rectangular in shape. According to this embodiment, the elongated edges of mopping cloth 260 are held by attachment sections 250.

Figure 7:
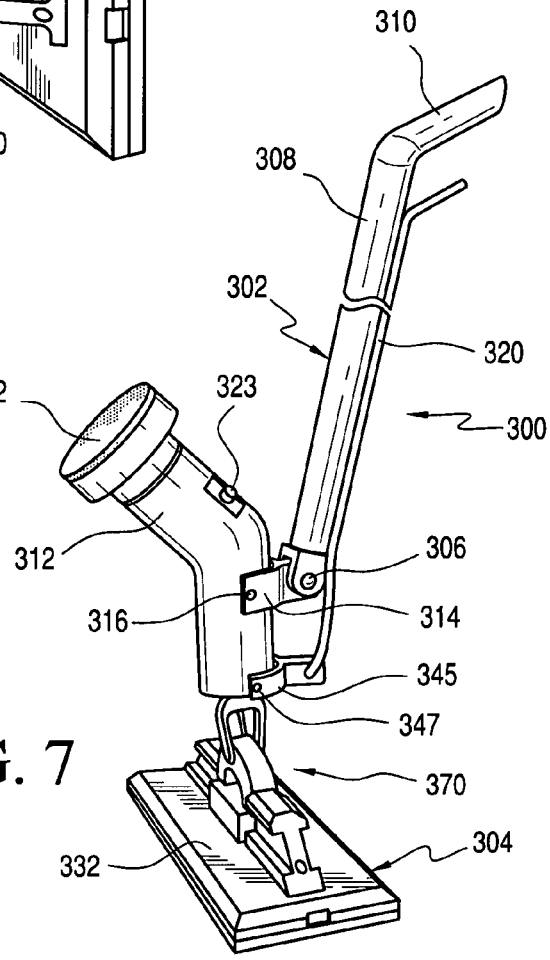
FIG. 7 is a perspective view of a cleaning tool in a mopping position according to an alternate embodiment of the present invention.

FIG. 7 is a perspective view of a cleaning tool 300 in a mopping position according to an alternate embodiment of the present invention. Cleaning tool 300 comprises a handle assembly 302 connected to mop head 304. According to the illustrated embodiment, power head 312 is integral to and pivots with mopping platform 332. Handle assembly 302 pivots with respect to mop head 304 about pivot joint 306. The act of pivoting enhances portability of cleaning tool 300 and permits mop head 304 to reach underneath household structures, such as tables and chairs, while maintaining operator control.

Handle assembly 302 includes extension member 308 terminating at a proximal end in handle grip 310. As illustrated, extension member 308 connects to power head 312 about pivot joint 306, and power head 312 in turn connects to mopping platform 332. Power head 312 connects to pivot joint 306 by way of collar member 314. According to the illustrated embodiment, collar member 314 is a U-shaped member disposed about power head 312 and is attached thereto by way of attachment pins 316. According to an alternate embodiment, collar member 314 is integrally formed with the housing for power head 312. As illustrated, pivot handle 320 is attached to mop head 304 by way of collar member 345. According to an alternate embodiment, collar member 345 is integrally formed with the housing for power head 312. As illustrated, collar member 345 itself it attached to power head 312 by way of attachment pins 347. Pivot handle 320 is pivotally attached to collar member 345 by way of pivot joint 349. Pivot handle 320 induces rotation of mop head 304 about pivot joint 306 to change between a mopping position and a scrubbing position. According to an alternate embodiment, pivot handle 320 is slidably attached to extension member 308 by way of a tubular collar member disposed about the periphery of extension member 308. According to an alternate embodiment, the tubular collar is a C-shaped tubular collar that does not fully extend around extension member 308.

Power head 312 provides support to scrub head 322. According to an embodiment, scrub head 322 is statically attached to power head 312. According to a preferred embodiment, power head 312 includes a powered motor assembly, set forth in greater detail below, to selectably engage and induce agitation in scrub head 322 by way of activation switch 323 in power head 312. According to a preferred embodiment, power head 312 rotatably engages scrub head 322 during a cleaning operation. According to an alternate embodiment, activation switch 323 may be provided in a remote location, such as on handle grip 310. According to yet another alternate embodiment, activation switch 323 is replaced by a sensor that responds to positioning of power head 312 in a scrubbing position by providing power thereto.

Mop head 304 includes a mopping platform 332 that is configured to engage an absorbent or soil attracting mopping material, such as a mopping cloth or a mopping cartridge. According to an embodiment, mop head 304 is structurally configured as set forth above with reference to FIGS. 5 and 6 to support mopping cloth 260. Alternately, mopping platform 332 is configured to engage a mop head cartridge, as set forth in greater detail below. Mop head 304 is pivotally attached to power head 312 by way of universal joint 370, as set forth in greater detail below with regard to FIG. 8.

Figure 8:
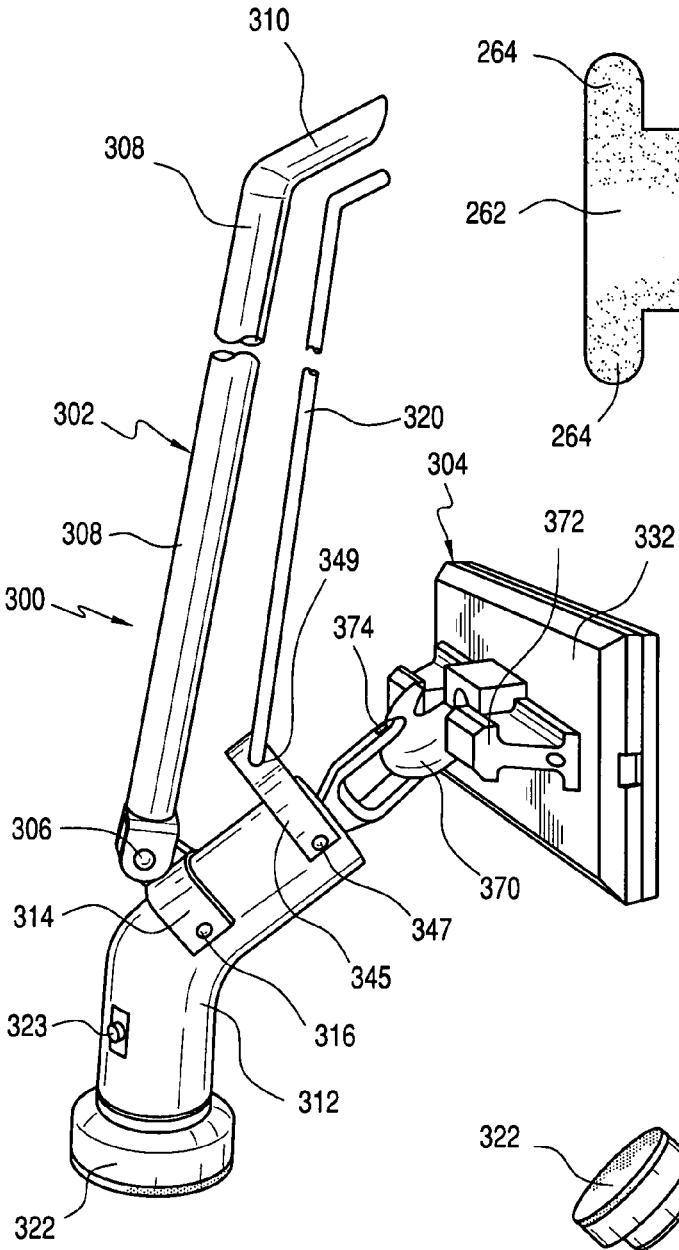
FIG. 8 is a perspective view of the cleaning tool of FIG. 7 transformed into a scrubbing position.

FIG. 8 is a perspective view of the cleaning tool 300 transformed from the mopping position of FIG. 7 into a scrubbing position. In order to transform cleaning tool 300 into the scrubbing position, pivot handle 320 is pulled proximally toward the operator in order to pivot mop head 304, including mopping platform 332, with respect to handle assembly 302. Pivot handle 320 is pulled linearly toward handle grip 310, which causes power head 312 to pivot about pivot joint 306 such that mopping platform 332 is nearly flush with the back side of extension member 308. Power head 312 is then disposed in a position such that scrub head 322 is in a position for cleaning a cleaning surface. Power head 312 includes an activation switch 323 that controls power head 312 to energize and thereby induce agitation in scrub head 322. Preferably, scrub head 322 rotates to provide the agitation to the cleaning surface. Activation switch 323 may be optionally disposed at a remote location from power head 312, such as on handle assembly 302, or may be a sensor that responds to transformation of cleaning tool 300 from the mopping position into the scrubbing position.

Universal joint 370 pivotally connects mopping platform 332 to power head 312 about first pivot axis 372 and a second pivot axis 374. First pivot axis 372 permits lateral movement of handle assembly 302 with respect to mopping platform 332. Likewise, second pivot axis 374 permits frontward and backward movement of handle assembly 302 with respect to mopping platform 332. Universal joint 370 thereby permits pivoting of mopping platform 332 in two dimensions with respect to handle assembly 302. According to an alternate embodiment, universal joint 370 is formed as a ball and socket joint.

Figures 9, 10, 11:
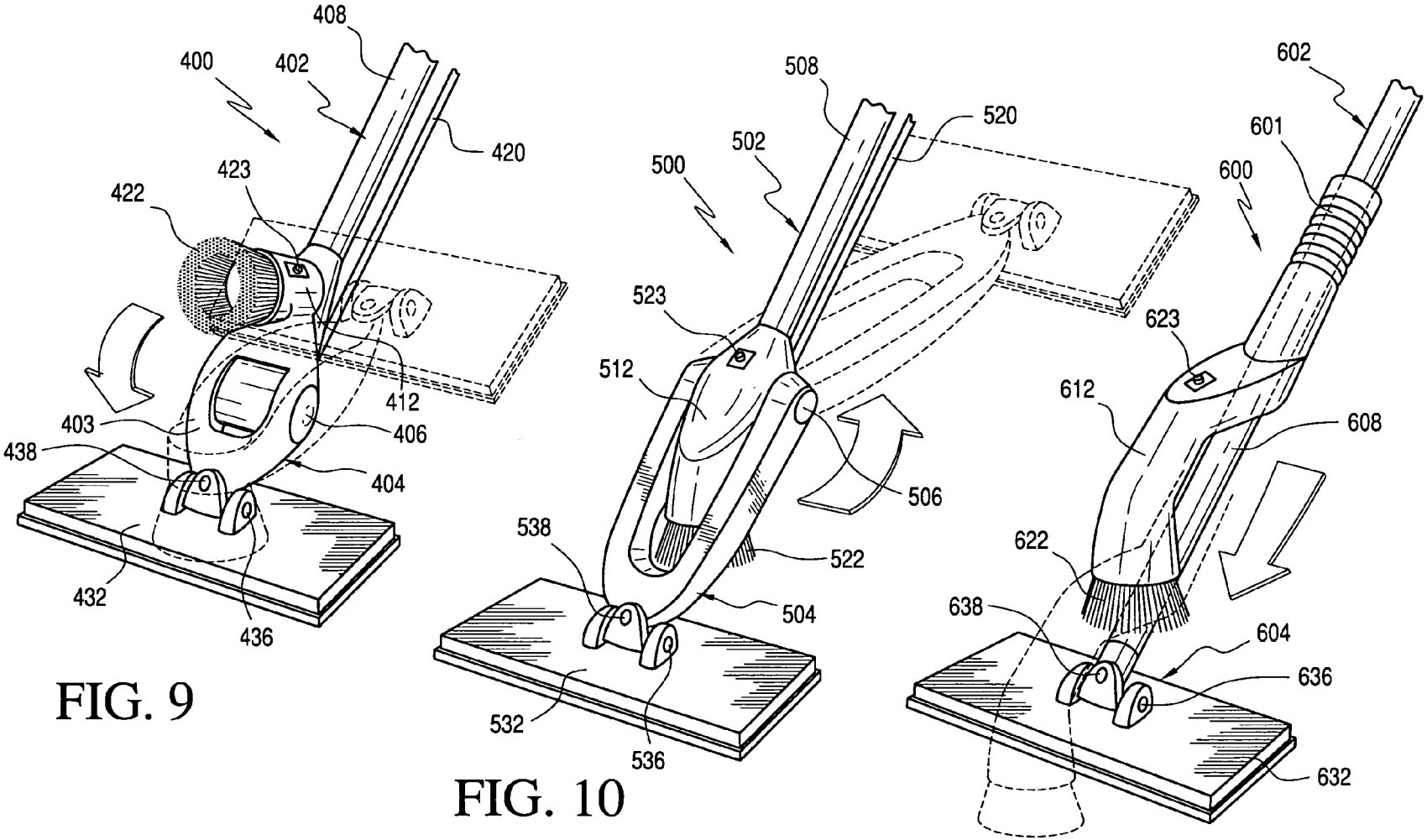
FIG. 9 is a perspective view of a cleaning tool according to an alternate embodiment of the present invention.
FIG. 10 is a perspective view of a cleaning tool according to another alternate embodiment of the present invention.
FIG. 11 is a perspective view of a cleaning tool according to yet another alternate embodiment.

FIG. 9 is a perspective view of a cleaning tool 400 according to an alternate embodiment of the present invention. Cleaning tool 400 includes handle assembly 402 connected at a distal end to mop head 404. According to the illustrated embodiment, handle assembly 402 pivots with respect to mop head 404 about pivot joint 406. Handle assembly 402 includes extension member 408 terminating at a proximal end in a handle grip (not shown) and terminating at a distal end in mop head 404. Power head 412 is integrally formed with mop head 404 and is connected to mopping platform 432 by way of pivot joints 436 and 438. Alternately, pivot joints 436 and 438 may be replaced by a universal joint, as set forth above. In order to engage scrub head 422, mop head 404 is pivoted about pivot joint 406 by way of pivot handle 420.

Mop head 404 provides support to scrub head 422 and mopping platform 432 by way of support structure 403. The support structure 403 is preferably a molded plastic housing. According to an embodiment, scrub head 422 is statically attached to power head 412. According to a preferred embodiment, power head 412 includes a powered motor assembly (not shown) to selectably engage and induce agitation in scrub head 422 by way of activation switch 423. Alternately, activation switch 423 may be provided on handle assembly 402 or may be a sensor that responds to conversion from the illustrated mopping position into the scrubbing position (shown in dashed lines). Power head 412 preferably includes a motor assembly powered by batteries, such as rechargeable batteries (not shown). Alternately, the powered motor assembly is powered through an electrical connection to conventional household power.

FIG. 10 is a perspective view of a cleaning tool 500 according to another alternate embodiment. Cleaning tool 500 includes handle assembly 502 connected at a distal end to mop head 504 about pivot joint 506. Handle assembly 502 includes extension member 508 terminating at a proximal end in a handle grip (not shown) and terminating at a distal end in an integrally connected power head 512. Mop head 504 is connected to extension member 508 through rotatable connection about pivot joints 506 on alternate sides of power head 512. Mop head 504 provides support to mopping platform 532 by way of pivot joints 536 and 538. Alternately, pivot joints 536 and 538 may be replaced by a universal joint, as set forth above.

In order to engage scrub head 522, mop head 504 is pivoted about pivot joints 506 by way of pivot handle 520. According to a preferred embodiment, power head 512 includes a powered motor assembly (not shown) to selectably engage and induce agitation in scrub head 522 by way of activation switch 523. Alternately, activation switch 523 may be provided on handle assembly 502 or may be a sensor that responds to conversion from the illustrated mopping position into the scrubbing position (shown in dashed lines). Power head 512 preferably includes a motor assembly powered by batteries, such as rechargeable batteries (not shown). Alternately, the powered motor assembly is powered through an electrical connection to conventional household power.

FIG. 11 is a perspective view of a cleaning tool 600 according to another alternate embodiment. Cleaning tool 600 includes handle assembly 602 connected at a distal end to mop head 604. The mop head 604 includes mopping platform 632 that is connected to handle assembly 602 by way of pivot joints 636 and 638. The pivot joints 636 and 638 may alternately be replaced by a universal joint. Handle assembly 602 includes an extension member 608 terminating at a proximal end in a handle grip (not shown). A power head 612 is slidably disposed about extension member 608 by way of a slidable positioning mechanism 601.

In order to engage scrub head 622, power head 612 is slidably moved past mopping platform 632 into a scrubbing position. According to a preferred embodiment, power head 612 includes a powered motor assembly (not shown) to selectably engage and induce agitation in scrub head 622 by way of activation switch 623. Alternately, activation switch 623 may be provided on handle assembly 602 or may be a sensor that responds to conversion from the illustrated mopping position into the scrubbing position (shown in dashed lines). Power head 612 preferably includes a motor assembly powered by batteries, such as alkaline or rechargeable batteries (not shown). Alternately, the powered motor assembly is powered through an electrical connection to conventional household power.

Figure 12:
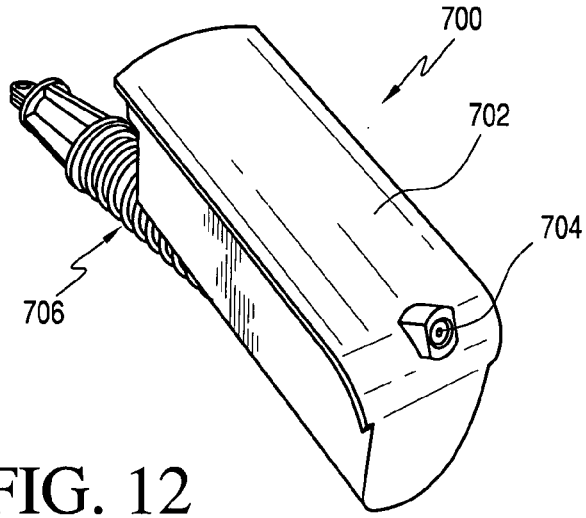
FIG. 12 is a perspective view of a nozzle assembly removed from a cleaning tool for use with the present invention.

FIG. 12 is a perspective view of a nozzle assembly 700 removed from a cleaning tool for clarity. Nozzle assembly 700 comprises a housing 702 supporting spray nozzle 704 and pump mechanism 706. According to the illustrated embodiment, housing 702 is configured for flush mounting on a mop head or power head as set forth above. Alternately, housing 702 may be configured in a functional and aesthetic design as an external nozzle assembly, illustrated in FIG. 3 by reference number 224. Alternately, housing 702 may be integrally formed with the housing for a power head or integrally formed with the housing for a mop head. According to an embodiment, pump mechanism 706 is controlled in response to mechanical action by an operator, such as by way of a mechanical linkage attached to a trigger switch. According to another embodiment, pump mechanism 706 is connected to an electric motor for inducing the pumping movement in response to an electrical switch controlled by an operator.

Figure 13:
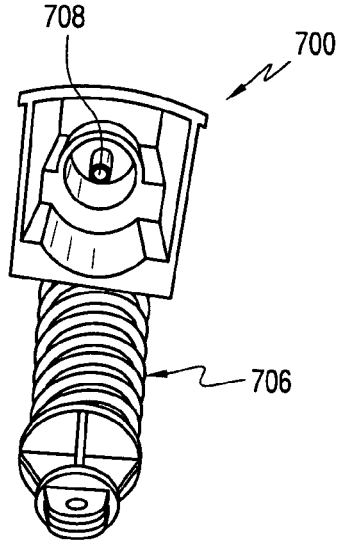
FIG. 13 is a rear view of the nozzle assembly of FIG. 12.

FIG. 13 is a rear view of the nozzle assembly 700 of FIG. 12. As illustrated, nozzle assembly 700 includes a liquid intake 708 that is configured and arranged to receive a liquid supply tube, such as fluid line 227 of FIG. 3. Mechanical action of pump mechanism 706 draws liquid into liquid intake 708 and out through spray nozzle 704.

Figure 14:
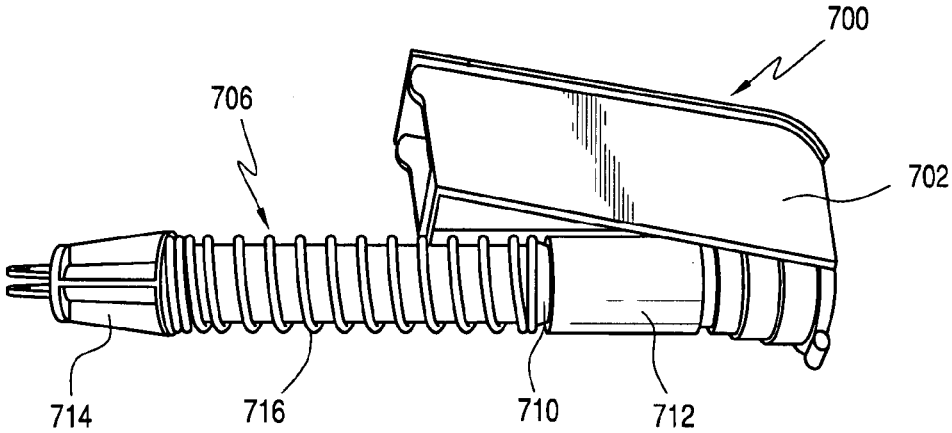
FIG. 14 is a side view of the nozzle assembly of FIG. 12.
Figure 15:
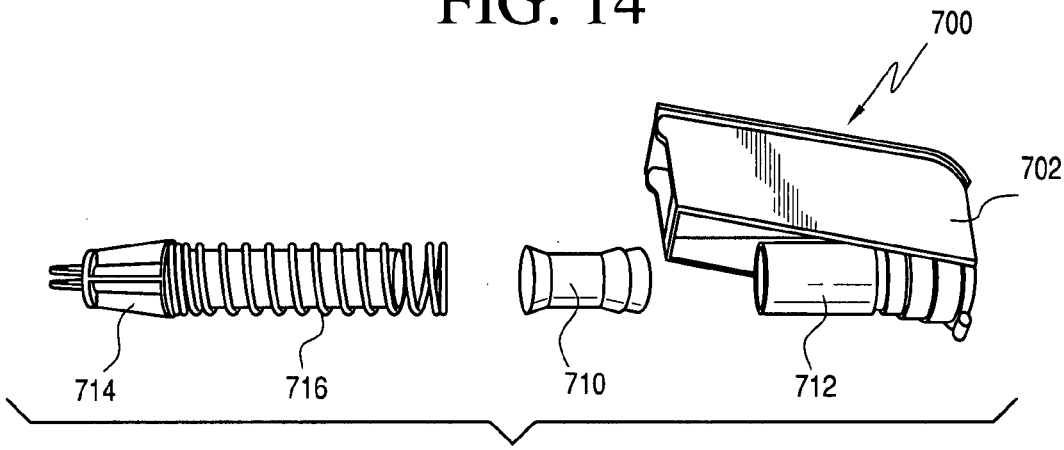
FIG. 15 is an exploded perspective view of the nozzle assembly of FIG. 12.

FIGS. 14 and 15 are respective side and exploded views of the nozzle assembly 700 of FIG. 12. Pump mechanism 706 is connected to housing 702 and is in fluid communication with spray nozzle 704. Pump mechanism 706 includes piston 710 that cooperates with cylinder 712 to draw liquid into fluid intake 708. Actuator 714 is mechanically moved frontwardly to push piston 710 into cylinder 712 and mechanically moved rearwardly to pull piston 710 from cylinder 712. Actuator 714 is connected to piston 710 and is urged outwardly therefrom by way of tension member 716. Preferably, tension member 716 is a spring. The combination of frontward and backward motion of actuator 714 thereby induces the combination of piston 710 and cylinder 712 to draw liquid into fluid intake 708. Actuator 714 may be attached to a mechanical spray trigger (not shown) by way of a mechanical linkage. Alternately, actuator 714 may be attached to an electric motor (not shown), which in turn is attached to an electrical switch.

Figure 16:
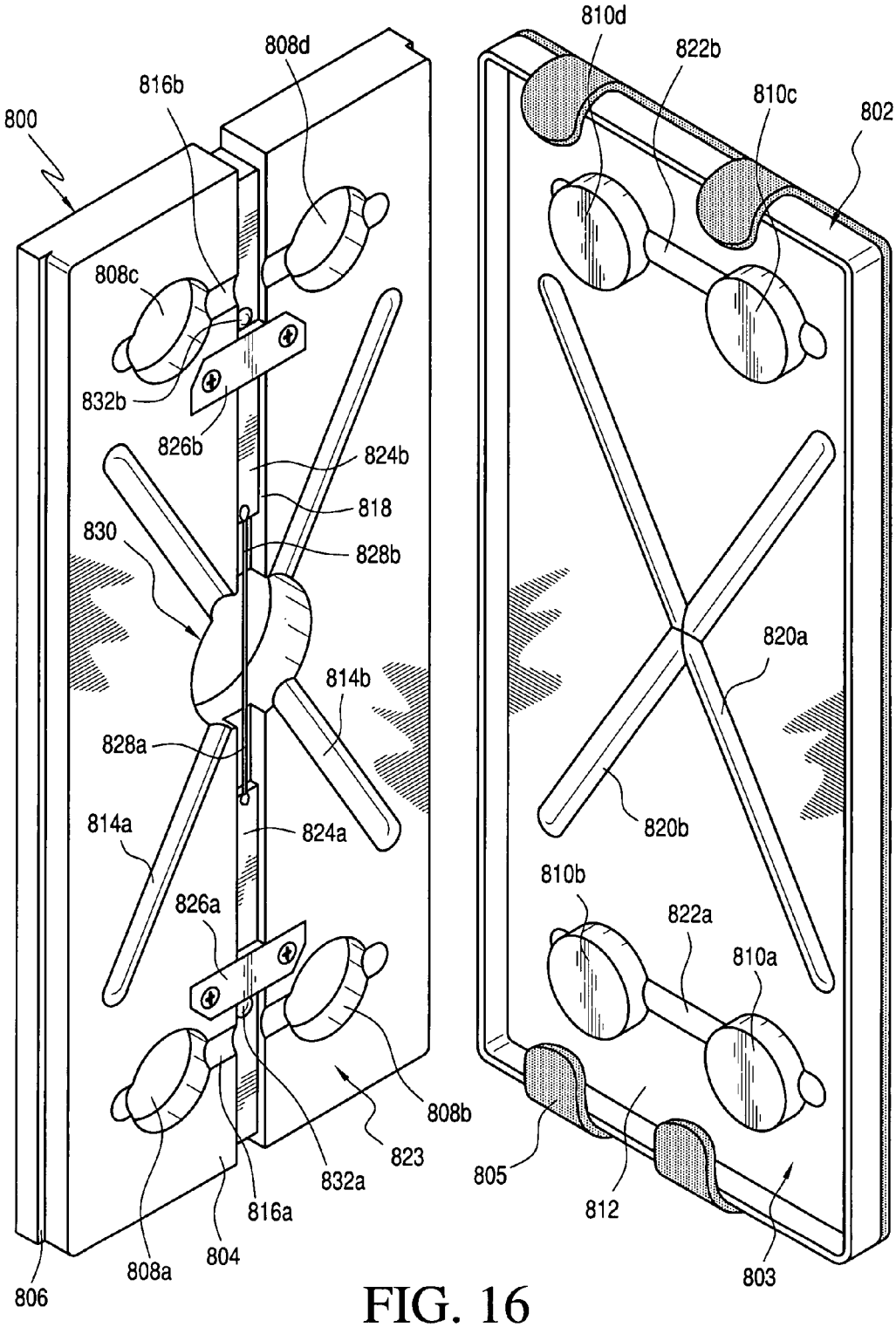
FIG. 16 is a perspective view of a mop head and removable mop cartridge for use with a cleaning tool according to an embodiment of the present invention.

FIG. 16 is a perspective view of a mop head 800 and removable mop cartridge 802 according to an embodiment of the present invention. Mop head 800 is configured and arranged to be supported by way of a handle assembly as part of a cleaning tool as set forth by the embodiments of the present invention. Mop head 800 has a generally flat lower surface 804 terminating on at least a first side in a cartridge engagement section 806. Preferably, cartridge engagement section 806 is an elongated ridge 806. The elongated ridge 806 is configured to mate with a portion of mop cartridge 802 to form a nearly flush seam. Alternately, mop head 800 may have a plurality of elongated sides ridges or side grooves that are configured to mate with corresponding structures in mop cartridge 802. Mop cartridge 802 is generally formed from a molded sheetlike member 803 having a generally flat outer contact surface to which a mopping material 805 is permanently bonded. Sheetlike member 803 is preferably a semi-rigid, thin plastic member. Alternately, sheetlike member 803 may be formed from moisture resistant, pressure stamped cardboard or metal. The mopping material 805 is preferably an absorbent material such as mopping cloth 260 illustrated in FIG. 6. Mop cartridge 802 may be removed from mop head 800 for cleaning. Preferably, mop cartridge 802 is disposable to maintain a hygienic condition during use by an operator.

Mop head 800 comprises mopping platform 823, wherein platform 823 defines a lower surface 804. The lower surface 804 has a plurality of cartridge engagement sections 808*a-d* for engaging a plurality of corresponding engagement sections 810*a-d* in mop support 803 of cartridge 802. Preferably, the cartridge engagement sections 808*a-d* are indentions disposed in lower surface 804 for receiving a plurality of corresponding protrusions 810*a-d* extending from a proximal side 812 of mop support 803. Indentions 808*a-d* are preferably cylindrical indentions, and more preferably have a circular cross section. Likewise, protrusions 810*a-d* are preferably cylindrical protrusions, and more preferably have a circular cross section. According to a preferred embodiment, mop cartridge 802 is held to mop head 800 by way of friction contact between engagement sections 808*a-d* and engagement sections 810*a-d*. According to another embodiment, indentions 808*a-d* and protrusions 810*a-d* cooperate with a bonding element, such as a combination of hook and loop type fasteners or tacky adhesive such as silicone gel to hold mop cartridge 802 to mop head 800. According to an alternate embodiment, protrusions are provided on lower mop head surface 804 with a corresponding plurality of indentions on proximal cartridge side 812. Yet another embodiment provides a plurality of protrusions and indentions on lower mop head surface 804 with a corresponding plurality of indentions and protrusions on proximal cartridge side 812. According to yet another embodiment, indentions 808*a-d* and protrusions 810*a-d* are replaced by a combination of hook and loop type fasteners or tacky adhesive such as silicone gel to hold mop cartridge 802 to mop head 800.

As illustrated, mop head 800 preferably comprises a plurality of engagement sections, such as diagonal elongate indentions 814*a*, 814*b*, and lateral indentions 816*a*, 816*b*. Proximal cartridge side 812 likewise includes a plurality of corresponding engagement sections, namely diagonal elongate protrusions 820*a*, 820*b* and lateral protrusions 822*a*, 822*b*, for respectively mating with diagonal elongate indentions 814*a*, 814*b* and lateral indentions 816*a*, 816*b*, through friction engagement.

Lower mop head surface 804 further defines an elongate channel 818 which extends along surface 804 and terminates in the lateral sides of mop head 800. Channel 818 slidably receives ejection members 824*a*, 824*b*. The operation of ejection members 824*a*, 824*b* is discussed in greater detail below with respect to FIG. 17. Ejection members 824*a*, 824*b* are slidably held within channel 818 by way of retention members 826*a*, 826*b*, and are respectively attached to flexible members 828*a*, 828*b*. The flexible members 828*a*, 828*b* are preferably wire strands, and pass through center hole 830 defined in mop head 800 and are attached to a release trigger (not shown). The flexible members 828*a*, 828*b* may alternatively be formed from cord, such as woven cord or nylon cord. The release trigger may be a handle or rotatable knob disposed on top side of mop head 800 opposite from illustrated lower surface 804. Alternately, the flexible members 828*a*, 828*b* may extend into a handle assembly and the release trigger may be disposed on a handle grip of the handle assembly. Each of the ejection members 824*a*, 824*b* further includes respective stop rivets 832*a*, 832*b* for limiting movement of the ejection members within channel 818, as described in greater detail below. According to an alternate embodiment, flexible members 828*a*, 828*b* are replaced by generally rigid members having angled pivotable end sections. In this alternate embodiment, the angled end sections are each disposed within a corresponding angled groove section of elongated channel 818 such that as the generally rigid members are pulled toward center hole 830, the corresponding angled end sections pivot outwardly from lower surface 804 to eject cartridge 802.

Figure 17:
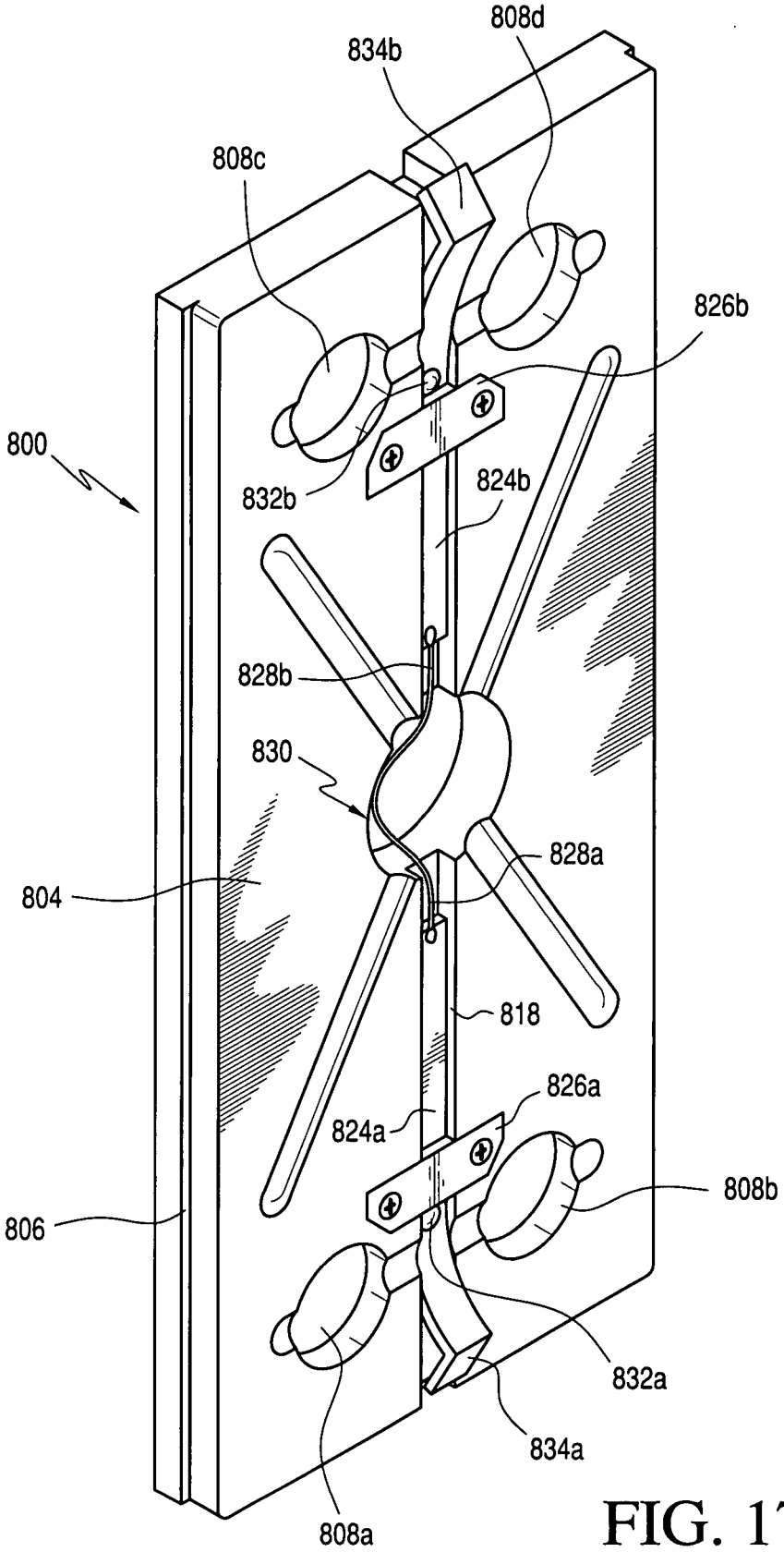
FIG. 17 is a perspective view of the mop head of FIG. 16 showing operation of the mop head for disengagement of a mop cartridge according to an embodiment of the present invention.

FIG. 17 is a perspective view of the mop head 800 of FIG. 16 showing an operation for disengagement of mop cartridge 802. As flexible members 828*a*, 828*b* are pulled inwardly through center hole 830, the respectively attached ejection members 824*a*, 824*b* are urged inwardly towards center hole 830. Ejection members 824*a*, 824*b* flexibly deform and protrude outwardly from lower surface 804 to disengage mop cartridge 802. According to an alternate embodiment, ejection members 824*a*, 824*b* have angled end sections that pivot to protrude outwardly from lower surface 804. As illustrated, stop rivets 832*a*, 832*b* prohibit over extension of ejection members 824*a*, 824*b*. Upon release of flexible members 828*a*, 828*b*, tension in the flexibly deformable ejection members 824*a*, 824*b* urge return thereof into channel 818 below lower surface 804. According to an alternate embodiment, springs (not shown) are provided between ejection members 824*a*, 824*b* and mop head 800, such as between stop rivets 832*a*, 832*b* and retention members 826*a*, 826*b*, to urge return of the ejection members into channel 818.

FIG. 18 is a perspective view of a power head 900 for use with a cleaning tool according to the present invention. Power head 900 comprises a housing 902 enclosing a power supply 904 disposed in a rear section 905 under control of an optional switch 906. According to an alternate embodiment, rear section 905 includes an optional electrical contact 903 that mates with a corresponding electrical contact on a handle assembly or other cleaning tool structure. The electrical contact 903 forms electrical communication with a switch disposed on the handle assembly or a sensor disposed on an associated cleaning tool structure. Housing 902 further supports an attachment head 908 in a front section 910 for releasably retaining scrub head 912.

Scrub head 912 releasably engages with attachment head 908 to permit use of different types of scrubbing members and to facilitate replacement thereof. According to the illustrated embodiment, scrub head 912 includes a support structure 914 having an engagement recess 916 to engage attachment head 908. A flexibly deformable section 918 is attached to support structure 914 for facilitating cleaning or scrubbing. According to an embodiment, section 918 is an absorbent sponge-like material or a flexibly deformable foam material. An optional scouring section 920 is permanently bonded to deformable section 918 for increasing effectiveness of the cleaning or scrubbing operation. Optional scouring section 920 is preferably a mesh of plastic fibers permanently bonded to section 918. During periodic use, scrub head 912 may be disengaged from attachment head 908 for cleaning, such as by soaking in bleach. Scrub head 912 may also be replaced after periodic use in response to wear.

According to an embodiment, scrub head 912 is statically attached to attachment head 908, and cleaning is provided through manual agitation of scrub head 912. According to a preferable embodiment, power head 900 includes a powered motor assembly, discussed in greater detail below, to selectably engage and induce agitation in scrub head 912 by way of an activation switch or sensor. According to a preferred embodiment, power head 912 rotatably engages scrub head 912 to induce the agitation during a cleaning operation. According to a preferred embodiment, the powered motor assembly is powered by batteries, such as alkaline or rechargeable batteries, illustrated below in FIG. 20. Alternately, the powered motor assembly is powered through an electrical connection to conventional household power.

FIG. 19 is a perspective view of a bristled scrub head 930 for use with the power head 900 of FIG. 18. Bristled scrub head 930 has a support structure 932 that is configured and arranged to mate with attachment head 908 of power head 900. A plurality of flexibly deformable bristles 934 is permanently attached to support structure 932 for agitating and loosening soil or dirt during a scrubbing operation. Bristles 934 are preferably synthetic strands, such as plastic strands. Alternately, bristles 934 may be closely packed fibrous strands, such as woven wool or cotton strands.

FIG. 20 is a sectional view of the power head 900 of FIG. 18. Housing 902 supports an attachment head 908 that is rotatably connected to motor 940 through mechanical linkage 942. Mechanical linkage 942 optionally includes reduction gears to increase torque applied to attachment head 908. Motor 940 is selectably engaged in electrical communication with power supply 904 by way of optional switch 906, electrical contacts 903, or a sensor. Battery 944 is disposed within power supply 904 and is electrically connected to motor 940 by way of optional switch 906, electrical contacts 903, or a sensor. According to embodiments of the invention, battery 944 is an alkaline or a rechargeable battery. According to an alternate embodiment, battery 944 is replaced within power supply 904 by a transformer for converting conventional household power into DC current for powering motor 940. According to yet another alternate alternate embodiment, battery 944 is a rechargeable battery and power supply 904 includes a transformer for charging the battery through connection to conventional household power.

Figure 21:
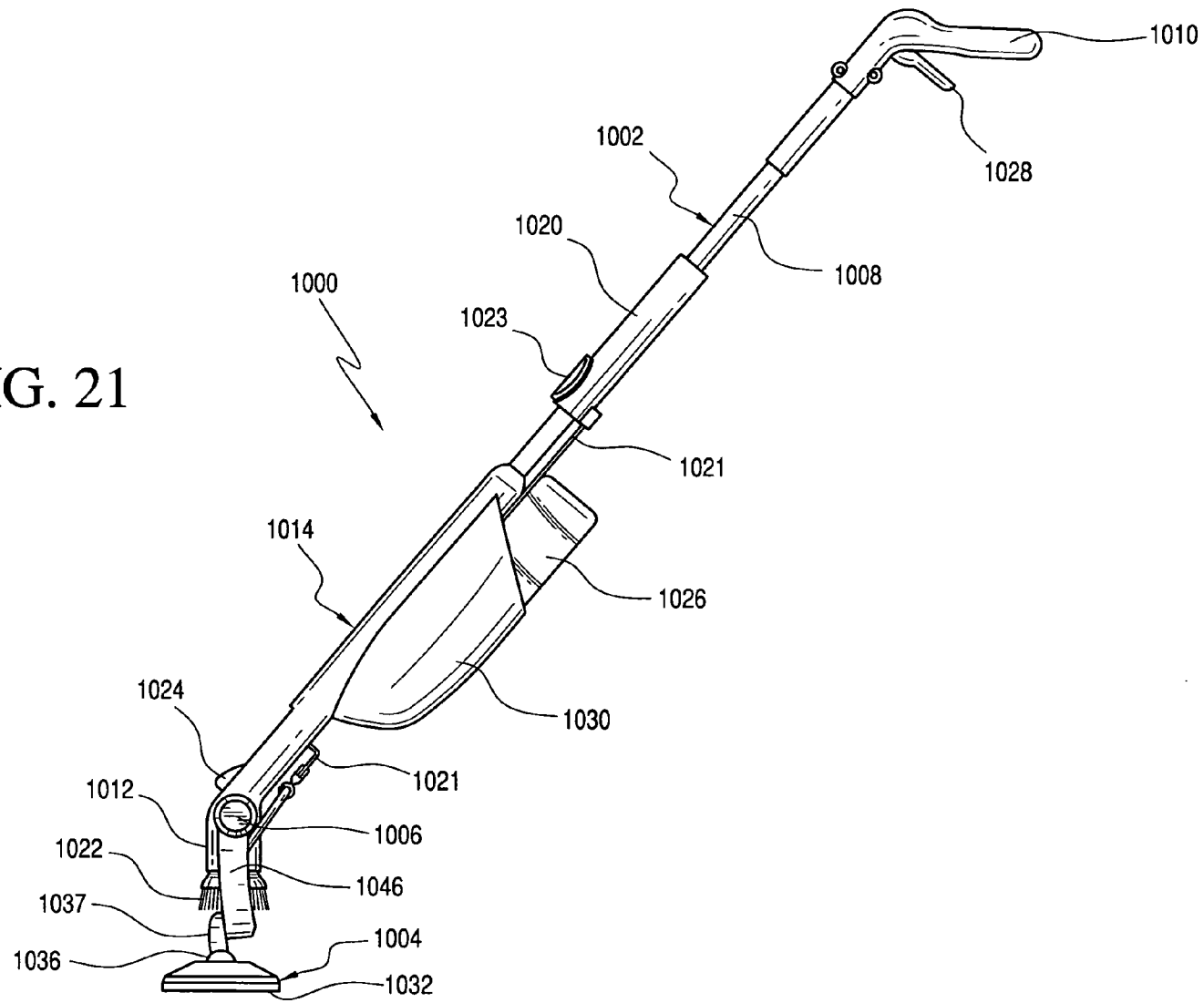
FIG. 21 is an elevated side view of a cleaning tool in a mopping position according to an embodiment of the present invention.
Figure 22:
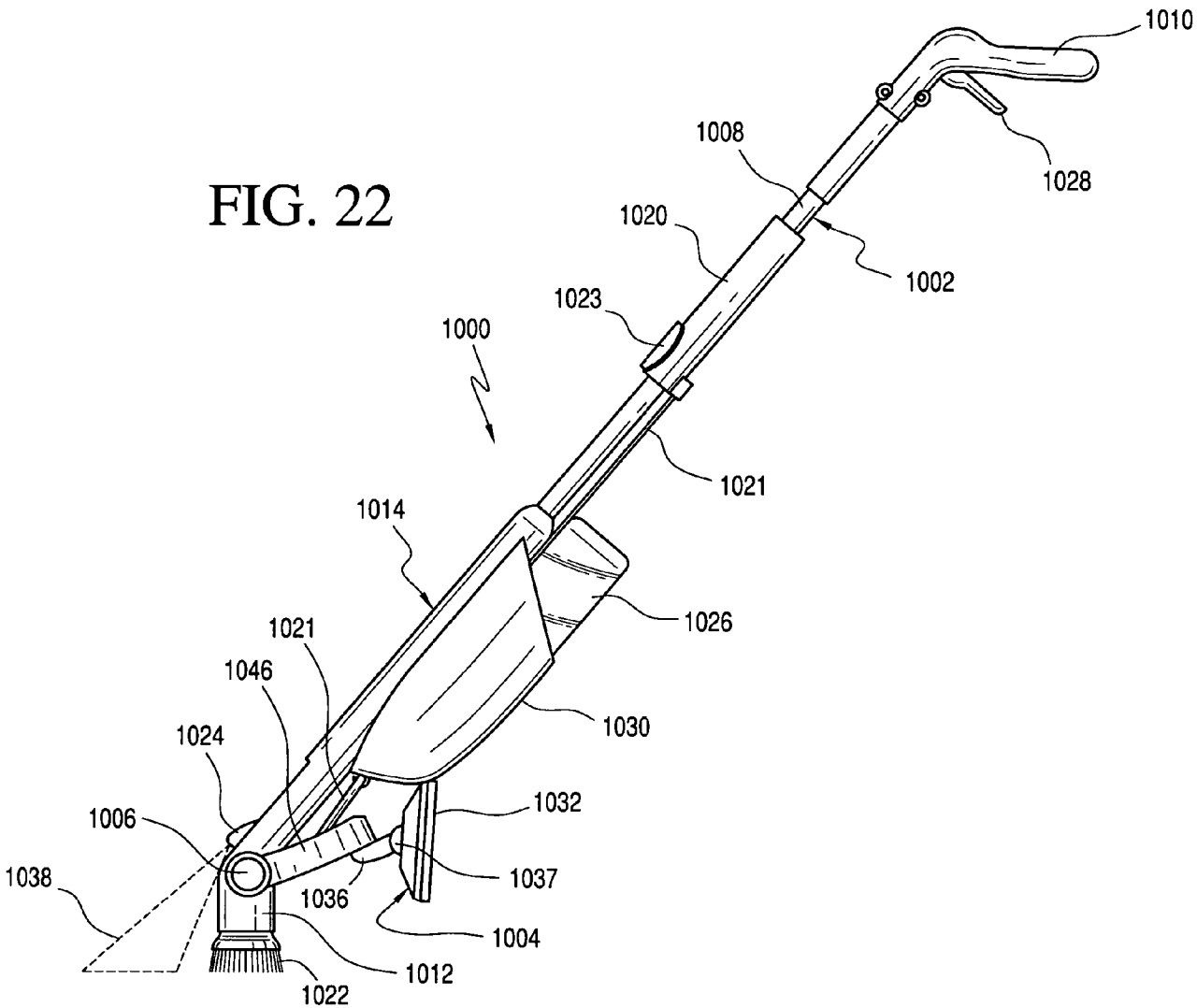
FIG. 22 is an elevated side view of the cleaning tool of FIG. 21 during in a scrubbing position.

FIG. 21 is an elevated side view of a cleaning tool 1000 in a mopping position according to an embodiment of the present invention. FIG. 22 is a side view of cleaning tool 1000 in a scrubbing position. Cleaning tool 1000 comprises a handle assembly 1002 connected to mop head 1004. According to the illustrated embodiment, handle assembly 1002 pivots with respect to mop head 1004 about pivot joints 1006. The act of pivoting about pivot joints 1036 and 1037 enhances portability of cleaning tool 1000 and permits mop head 1004 to reach underneath closely placed objects, such as household tables and chairs, while maintaining operator control.

Handle assembly 1002 includes extension member 1008 terminating at a proximal end in handle grip 1010 and terminating at a distal end in power head 1012. Extension member 1008 is preferably statically attached to power head 1012 by way of an integrated housing 1014. Alternately, power head 1012 has a housing that is statically connected to extension member 1008 by way of fastening members, such as rivets or screws, or a bonding agent, such as adhesive or glue. In accordance with the alternate embodiments set forth in greater detail above, power head 1012 may be optionally pivotally attached to extension member 1008. According to a preferred embodiment, extension member 1008 is formed from a plurality of connectable sections to facilitate packaging, storage, and portability. Alternatively, extension member 1008 is a single section elongated boom.

Cleaning tool 1000 further comprises a pivot control handle 1020 connected to mop head 1004 by conversion bar 1021. Preferably, control handle 1020 is a tubular collar that slidably engages an outer periphery of extension member 1008. Alternately, control handle 1020 is a semi-tubular collar that engages the outer periphery of extension member 1008 or a molded handle that slides adjacent to extension member 1008. According to the illustrated embodiment, handle assembly 1002 laterally pivots with respect to mop head 1004 about pivot joints 1036 and 1037. The act of pivoting enhances portability of cleaning tool 1000 and permits mop head 1004 to reach underneath household structures, such as tables and chairs, while maintaining operator control.

Power head 1012 provides support to scrub head 1022. According to an embodiment, scrub head 1022 is statically attached to power head 1012. According to a preferred embodiment, power head 1012 includes a powered motor assembly (set forth in greater detail below) to selectably engage and induce agitation in scrub head 1022 by way of an activation switch disposed within one of the pivot joints 1006. The activation switch is preferably a sensor that responds to conversion of cleaning tool 1000 from the mopping position into the scrubbing position. Alternatively, the activation switch may be a manually operated electrical switch disposed in handle grip 1010, power head 1012, or integrated housing 1014. Power head 1012 preferably includes a motor assembly powered by batteries, set forth in greater detail below. Alternately, the powered motor assembly is powered through an electrical connection to conventional household power.

Power head 1012 further includes a nozzle assembly 1024 that is in fluid communication with liquid reservoir 1026 by way of an internal fluid line, described in greater detail below. The fluid line is received within extension member 1008 and maintains fluid connection between nozzle assembly 1024 and fluid reservoir 1026. According to an alternate embodiment, the fluid line is partially disposed within integrated housing 1014. When the operator activates spray switch 1028 in handle grip 1010, liquid is released from liquid reservoir 1026 and out through spray nozzle assembly 1024. Preferably, spray switch 1028 is connected to a pump mechanism to pump liquid from liquid reservoir 1026. According to a preferred embodiment, liquid reservoir 1026 is a removable bottle that is held in cradle 1030 that is integrally formed with integrated housing 1014. As set forth above, extension member 1008 is also integrally formed as part of integrated housing 1014. According to an alternate embodiment, cradle 1030 is a separate member that is attached to extension member 1008 by way of fastening members or a bonding agent.

Power head 1012 is connected to mop head 1004 by way of pivot joints 1006. In particular, power head 1012 is connected to collar member 1046 about pivot joint 1006. Collar member 1046 is a U-shaped member that is disposed around power head 1012 and pivotally connected to power head 1012 by way of pivot joints 1006.

Pivot control handle 1020 is connected to collar member 1046 by way of conversion bar 1021. A release button 1023, described in greater detail below, is disposed on control handle 1020. When cleaning tool 1000 is disposed in the mopping position of FIG. 21, release button 1023 locks control handle 1020 with respect to extension member 1008. When release button 1023 is depressed, control handle 1020 may slide proximally toward handle grip 1010 under control of an operator. Control handle 1020 is attached to collar member 1046 by way of conversion bar 1021 and thereby induces pivotal movement of collar member 1046 about pivot joints 1006. When control handle 1020 is fully pulled toward handle grip 1010, release button 1023 locks cleaning tool 1000 into the scrubbing position of FIG. 22. Likewise, when control handle 1020 is fully pushed toward integrated housing 1014, release button 1023 locks cleaning tool 1000 into the mopping position of FIG. 21. Conversion bar 1021 is slidably received within integrated housing 1014. According to an alternate embodiment, conversion bar 1021 is disposed external to integrated housing 1014 for attachment to control handle 1020.

Mop head 1004 includes a mopping platform 1032 that is configured to engage an absorbent or soil attracting mopping material that is suitable for wet mopping, damp mopping, and/or dry mopping. Mopping platform 1032 is connected at a top surface thereof to handle assembly 1002 by way of pivot joint 1036 and pivot joint 1037, described in greater detail below.

FIG. 22 is a perspective view of the mop head 1004 of the cleaning tool 1000 of FIG. 21 during a scrubbing operation. In order to transform from the mopping position into the scrubbing position, pivot handle 1020 is pulled proximally toward the operator in order to pivot mop head 1004 with respect to handle assembly 1002. Pivot handle 1020 is pulled linearly toward handle grip 1010, which causes collar member 1046 to pivot about pivot joints 1006. Accordingly, scrub head 1022 of power head 1012 is exposed for cleaning. When pivot handle 1020 is fully pulled toward handle grip 1010, mopping platform 1032 touches the back side of caddy 1030, thereby exposing scrub head 1022 in a position for cleaning a cleaning surface. Upon activation of an activation switch or sensor, power head 1012 is energized to induce agitation in scrub head 1022. Preferably, scrub head 1022 rotates to provide the agitation to the cleaning surface.

Cleaning tool 1000 may be used during a spraying operation in the mopping position of FIG. 21, or in the scrubbing position of FIG. 22. Upon activation of spray switch 1028, a liquid flow is ejected from nozzle assembly 1024. According to an embodiment, nozzle assembly 1024 provides a fixed dispersion of liquid flow 1038. According to an alternate embodiment, liquid flow 1038 is optionally adjustable between a stream or an atomized spray. According to an embodiment, spray switch 1028 is a pump switch under manual control of an operator to induce a pumping ejection of the liquid flow 1038. According to another embodiment, spray switch 1028 is an electrical switch in communication with a motorized pump to control ejection of the liquid flow 1038 from nozzle assembly 1024.

Figure 23:
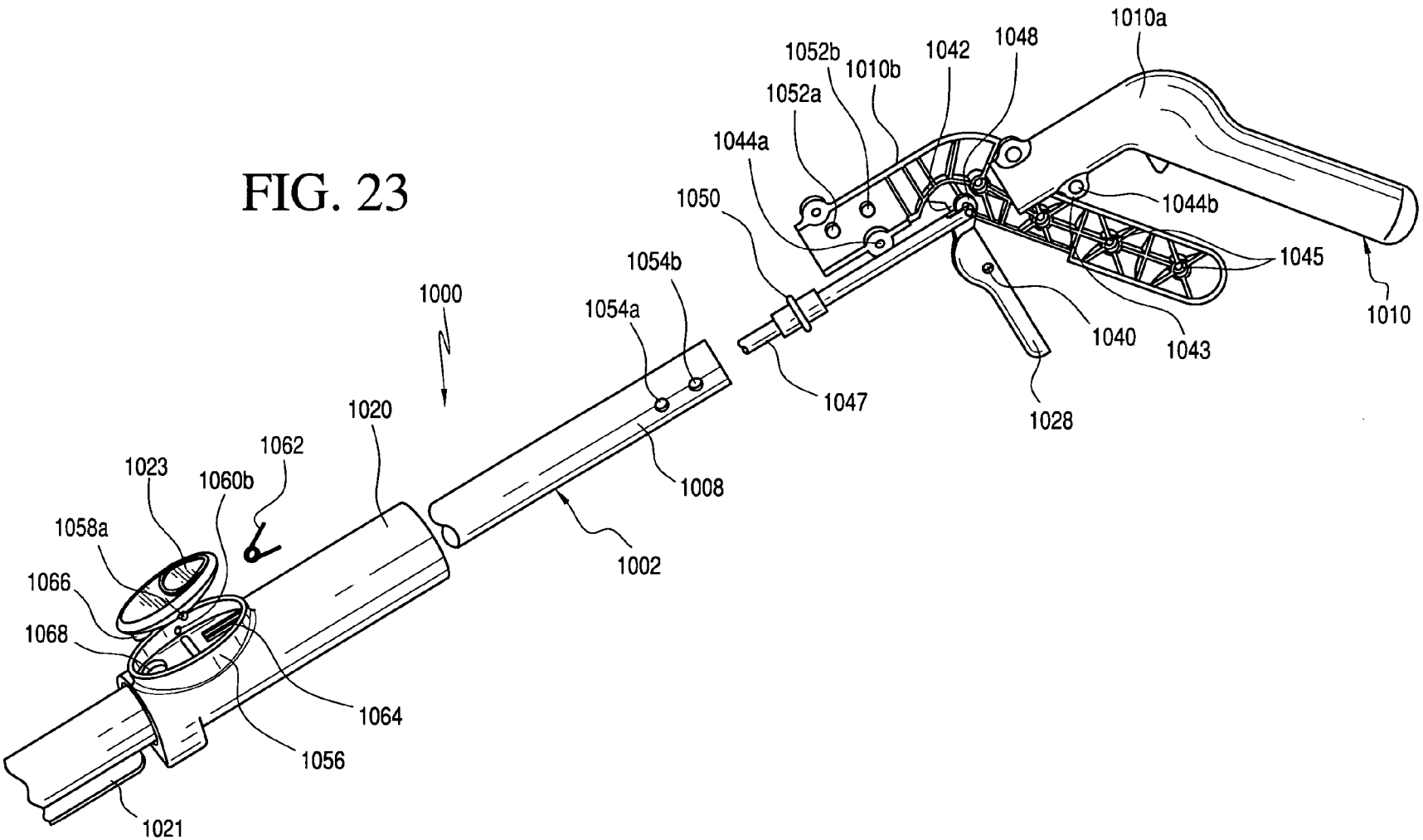
FIG. 23 is an exploded perspective view of a handle assembly of the cleaning tool of FIG. 21.

FIG. 23 is an exploded perspective view of handle assembly 1002 of cleaning tool 1000. Handle assembly 1002 includes handle grip 1010 formed from matable sections 1010*a* and 1010*b*. Spray switch 1028 is rotatably received within handle grip 1010 and pivots with respect to pivot member 1042 extending from matable section 1010*b*. The pivot member 1042 extends through pivot hole 1040 in spray switch 1028 and is received within a corresponding lug 1043 in matable section 1010*a*. The external side of lug 1043 is illustrated. According to an alternate embodiment, pivot member 1042 is a metal member disposed between matable sections 1010*a* and 1010*b*. Alternately, pivot member 1042 is formed from a pair of projections extending inward from each of matable sections 1010*a* and 1010*b*. The spray switch 1028 is pivotally connected to push rod 1047 within handle grip 1010 about pivot joint 1048. Accordingly, as spray switch 1028 is pulled toward handle grip 1010, push rod 1047 is pushed downwardly through extension member 1008 to thereby induce a pumping action in nozzle assembly 1024. Spray switch 1028 returns to the extended position away from handle grip 1010 by way of an elastic tension member (not shown) disposed within integrated housing 1014. A second optional elastic tension member, such as a spring, may be disposed within handle grip 1010 to urge spray switch 1028 toward the extended position away from handle grip 1010. Push rod 1047 does not rub against the interior sidewalls of tubular extension member 1008 due to placement of guide insert 1050 thereabout.

As illustrated, matable sections 1010*a*, 1010*b* each include fastening members 1052*a*, 1052*b* for respectively engaging side holes 1054*a*, 1054*b* in extension member 1008. Preferably, fastening members 1052*a*, 1052*b* are molded protrusions extending inwardly from matable sections 1010*a*, 1010*b*. Alternatively, fastening members 1052*a*, 1052*b* are rivets or screws configured to engage with side holes 1054*a*, 1054*b*. A pair of molded lugs 1044*a*, 1044*b* are correspondingly attached as part of handle grip matable sections 1010*a*, 1010*b*. Lugs 1044*a*, 1044*b* are configured as to receive a corresponding fastening member, such as a rivet or screw therethrough for connecting matable sections 1010*a*, 1010*b*. Additional molded lugs 1045 are illustrated in matable section 1010*b* of FIG. 23 for receiving additional fastening members (not shown) that extend from matable section 1010*a*.

Release button 1023 is pivotally attached within annular bead 1056 of pivot handle 1020 by way of a pair of pivot arms 1058*a*, 1058*b*. Each of the pivot arms 1058*a*, 1058*b* are respectively received within receiving indentions 1060*a*, 1060*b*. FIG. 23 only illustrates pivot arm 1058*a* and receiving indention 1060*b*. Biasing member 1062 is disposed between release button 1023 and a bottom section within annular bead 1056. Biasing member 1062 is preferably a metal spring. Biasing member 1062 is maintained in position by being placed in retention track 1064 within the bottom section within annular bead 1056. Release button 1023 includes release projection 1066 that is configured to be received within release hole 1068 in the bottom section within annular bead 1056. A second hole (not shown) is disposed in a side of extension member 1008. Thus, to lock pivot handle 1020 with respect to extension member 1008, release projection 1066 is inserted into release hole 1068 and the corresponding hole in extension member 1008. Likewise, when release button 1023 is depressed to thereby pivot release projection 1066 out from release hole 1068, the pivot handle 1020 may slide proximally toward handle grip 1010 to transform cleaning tool 1000 from the mopping position into the scrubbing position. Release button 1023 is then inserted into another corresponding hole in extension member 1008 to thereby lock cleaning tool 1000 into the scrubbing position.

Figure 24:
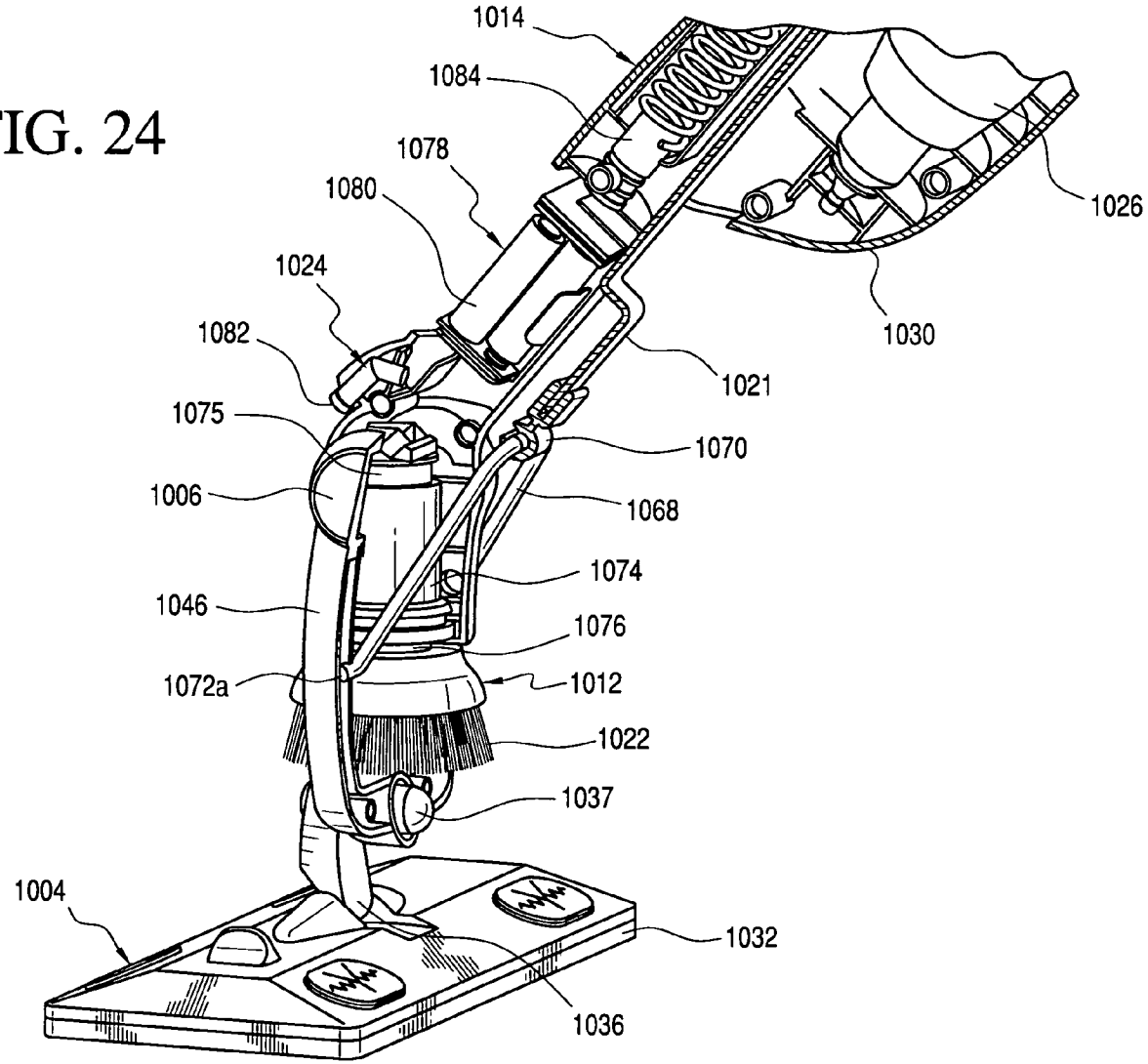
FIG. 24 is a partial sectional view of the power head and the mop head of the cleaning tool of FIG. 21.

FIG. 24 is a partial sectional view of the power head 1012 and the mop head 1004 of the cleaning tool 1000 of FIG. 21. As illustrated, conversion bar 1021 passes through integrated housing 1014 for attachment to pivot handle 1020 (shown in FIG. 23). According to a preferred embodiment, cradle 1030 is integrally molded with a lower section of handle assembly 1002 as integrated housing 1014. Conversion bar 1021 attaches to collar member 1046 by way of connection member 1068 and joint member 1070. Preferably, connection member 1068 is a U-shaped connection member pivotally connected to collar member 1046 about two connection joints 1072*a*, however only one is visible in this view. Accordingly, as conversion bar 1021 is pulled proximally toward the handle grip 1010, the collar member 1046 rotates about pivot joints 1006 and connection member 1068 pivots about connection joints 1072*a*, 1072*b* to thereby expose scrub head 1022 in the scrubbing position. Likewise, as conversion bar 1021 is pushed distally away from handle grip 1010, collar member 1046 rotates about pivot joints 1006 and connection member 1068 pivots about connection joints 1072*a*, 1072*b* to thereby return mop head 1004 into the mopping position.

Power head 1012 is illustrated in partial sectional form to illustrate placement of power drive unit 1074 and attachment head 1076. Power drive unit 1074 includes a plurality of gears (not shown) connected to motor 1075. Motor 1075 is preferably an electric motor in electrical communication with removable power supply 1078 and is partially received within power drive unit 1074. The gears within power drive unit 1074 are preferably planetary gears having a gear reduction ratio of 81:1. The power supply 1078 is a removable cartridge, preferably including a plastic shell with electrical contacts, that is configured and arranged to receive at least one battery 1080 or plural batteries. Power supply 1078 is configured for manual removal from integrated housing 1014 such that the batteries may be readily replaced. According to an embodiment, battery 1080 is an alkaline battery. According to an alternate embodiment, battery 1080 is a rechargeable battery that may be removed for charging. According to yet another embodiment, battery 1080 is recharged while being maintained within integrated housing 1014 of handle assembly 1002 by way of a battery charger (not shown). According to an embodiment, electrical communication between power drive unit 1074 and battery pack 1078 is provided by way of an electric switch or sensor, described in greater detail below with regard to FIG. 26. Accordingly, the electric leads have been removed from FIG. 24 for clarity. Nozzle assembly 1024 includes spray nozzle 1082, pump mechanism 1084 and associated tubing (not shown). The tubing is preferably a plurality of flexible tubing sections that connect spray nozzle 1082 to liquid reservoir 1026 by way of pump mechanism 1084. The flexible tubing and operation of pump mechanism 1084 is described in greater detail below.

Figure 25:
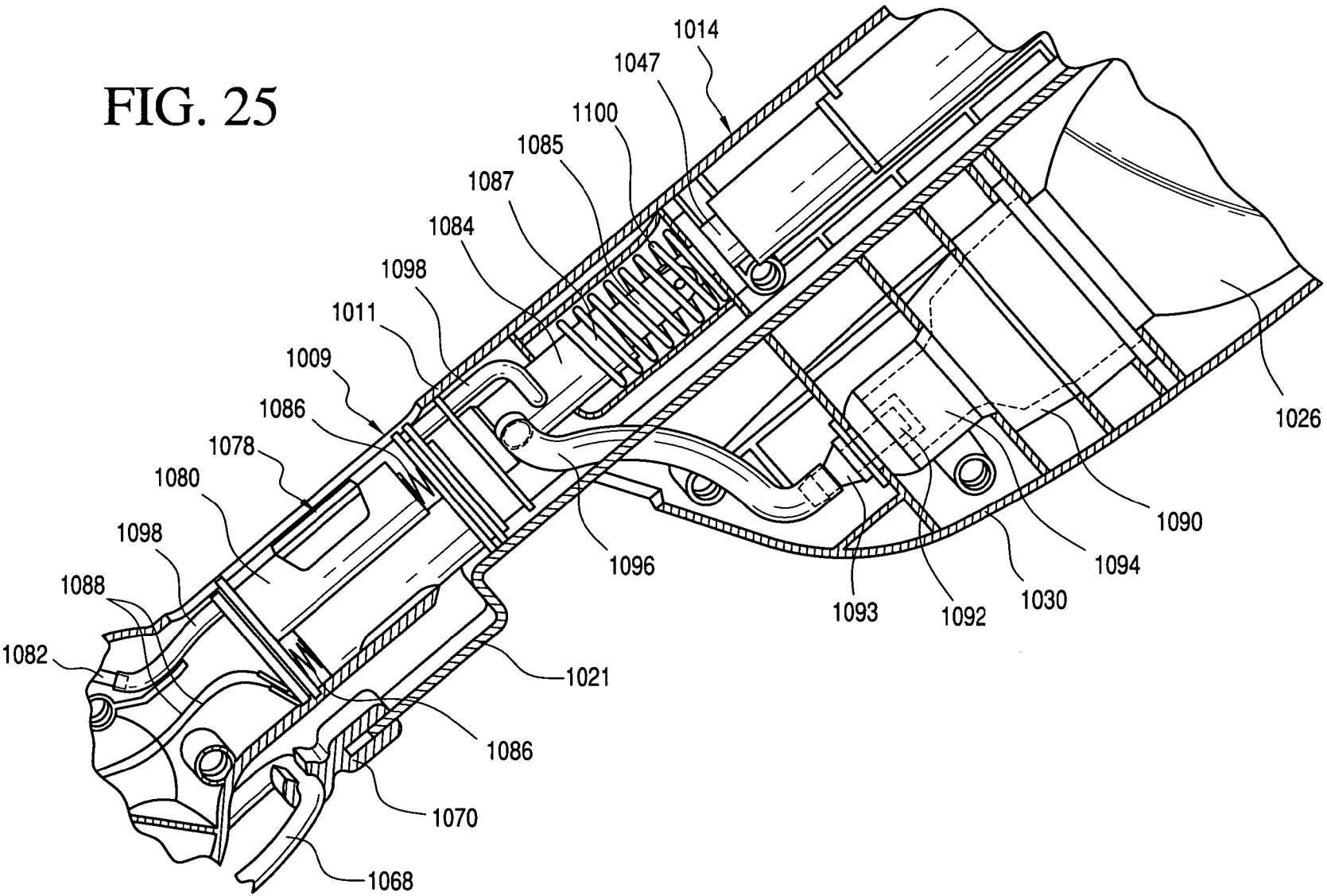
FIG. 25 is a detailed sectional view of a battery pack, pump mechanism, and liquid reservoir of the cleaning tool of FIG. 21.

FIG. 25 is a partial sectional view of the power supply 1078, pump mechanism 1084, and liquid reservoir 1026 of the cleaning tool 1000 of FIG. 21. Power supply 1078 is removably disposed within lower section 1009 of handle assembly 1002. As illustrated, lower section 1009 includes a molded tubular section 1011 integrally molded with cradle 1030 to form integrated housing 1014. Batteries 1080 are held within power supply 1078 by way of a pair of electrically conductive tension members 1086. The conductive members 1086 are in electrical communication with power leads 1088 within tubular section 1011. The power leads 1088 are connected to a switch, such as optional switch 906 of FIG. 20 or a sensor switch discussed in greater detail below with regard to FIG. 26.

Liquid reservoir 1026 is held within cradle 1030 by way of insertion into reservoir receiving section 1090. The receiving section 1090 is preferably molded from plastic and includes reservoir nipple 1092 and transmission nipple 1094. The reservoir nipple 1092 is configured to removably engage cap section 1094 of liquid reservoir 1026, described in greater detail below. Transmission nipple 1094 is configured for permanent attachment to first tubular section 1096 within cradle 1030. First tubular section 1096 attaches to pump mechanism 1084, while a second tubular section 1098 connects pump mechanism 1084 to spray nozzle 1082. A tension member 1100 is formed as part of pump mechanism 1084. Tension member 1100 returns piston 1085 to a resting position with respect to cylinder 1087 of pump mechanism 1084. Tension member 1100 also urges push rod 1047 proximally toward handle grip 1010, and thereby urges spray switch 1028 into the normal position. Tension member 1100 is preferably a coiled spring. As spray switch 1028 is pushed by the operator, push rod 1047 is urged downwardly against the force of tension member 1100 to thereby control pump mechanism 1084 to draw liquid from liquid reservoir 1026 and out from spray nozzle 1082.

Figure 26B:
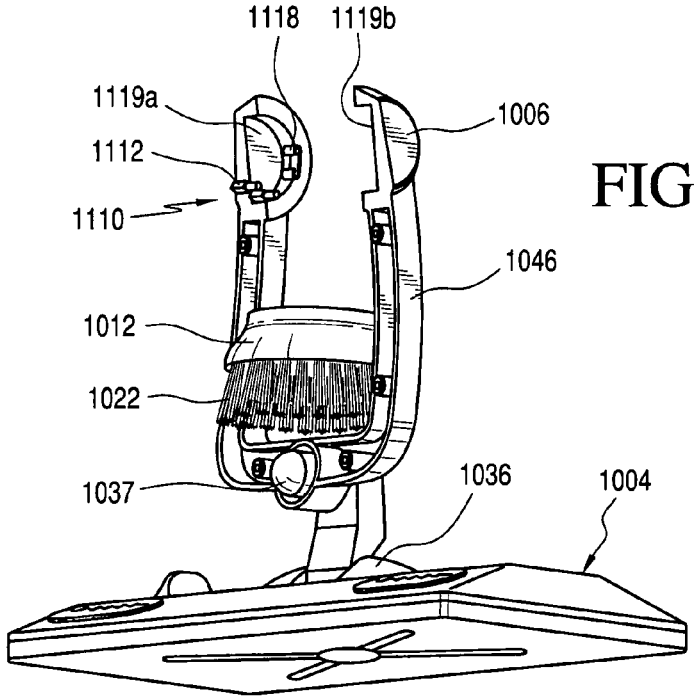
FIGS. 26A and 26B are elevated rear sectional views of the power head and the mop head of the cleaning tool of FIG. 21.
Figure 26A:
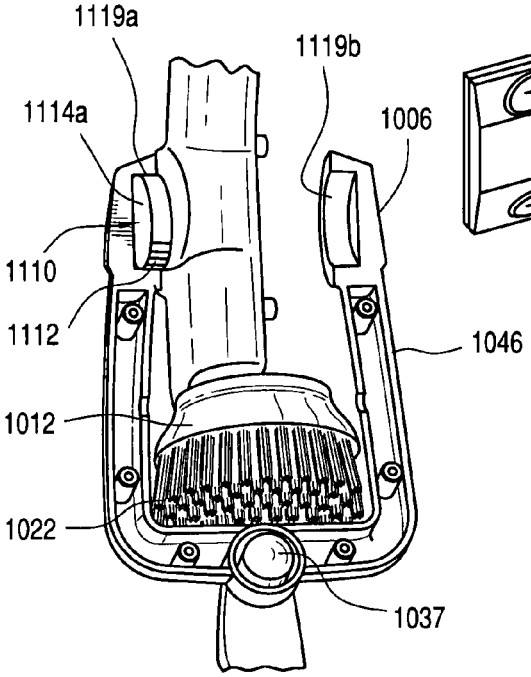
Figure 26C:
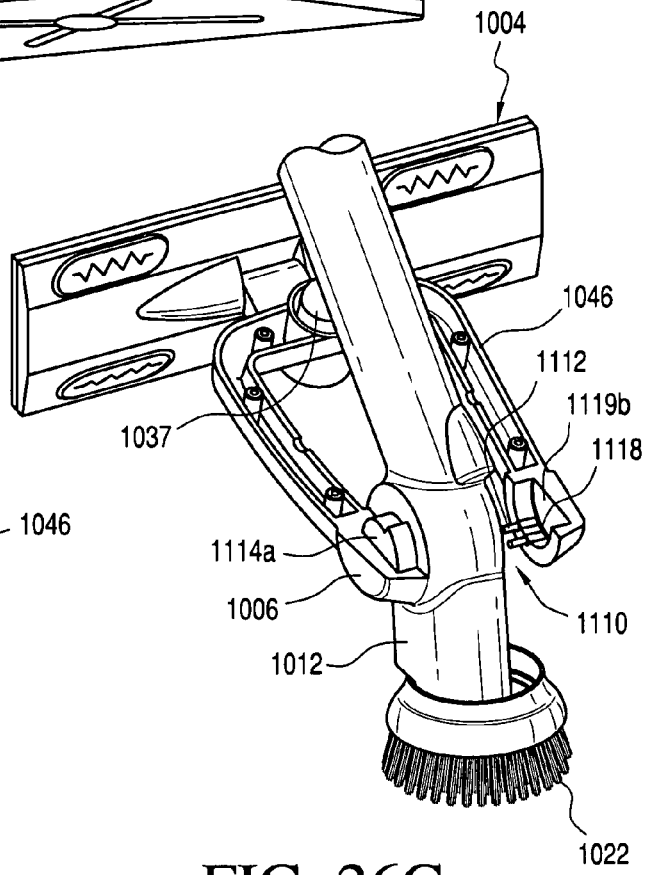
FIG. 26C is an elevated front sectional view of the power head and the mop head of FIGS. 26A and 26B.

FIGS. 26A and 26B are elevated rear sectional views of power head 1012 and mop head 1004 showing placement and activation of sensor mechanism 1110. FIG. 26C is an elevated front sectional view of power head 1012 and mop head 1004. With reference to FIG. 26A, a sensor mechanism 1110 is disposed within a stator section 1114*a* of power head 1012. Power head 1012 has two alternately disposed stator sections 1114*a*, however only one stator section 1114*a* is shown for clarity. During rotation of socket section 1119*a* of collar member 1046 about stator section 1114*a*, electrical contacts 1112 engage with a conductive plate 1118 (FIG. 26B) to thereby form an electrical connection between contacts 1112. Accordingly, formation of this electrical connection senses the rotation of collar member 1046 from the mopping position into the scrubbing position and thereby completes an electrical circuit to provide activation power to power head 1012.

FIG. 26B is an elevated rear partial sectional view that further illustrates sensor mechanism 1110 and electrical contacts 1112. The electrical contacts 1112 are disposed within and supported by stator section 1114*a*, however, in FIG. 26B stator section 1114*a* has been removed for clarity. As socket sections 1119*a* and 1119*b* of collar member 1046 rotates about stator section 1114*a*, electrical contacts 1112 engage conductive plate 1118 to complete the electrical circuit.

FIG. 26C is an elevated front partial sectional view further illustrating cleaning tool 1000 in the mopping position. As illustrated, electrical contacts 1112 are engaged with conductive plate 1118 to complete the electrical circuit. As set forth above, electrical contacts 1112 are optionally disposed within stator section 1114*b*, which has been removed for clarity. The sensor mechanism 1110 is shown in FIG. 26C in a position on the right hand side of collar member 1046. In FIGS. 26A and 26B, sensor mechanism 1110 is shown from a rear elevation view. Thus, as illustrated in FIG. 26C, sensor mechanism 1110 is positioned on the right side of collar member 1046.

Figure 27:
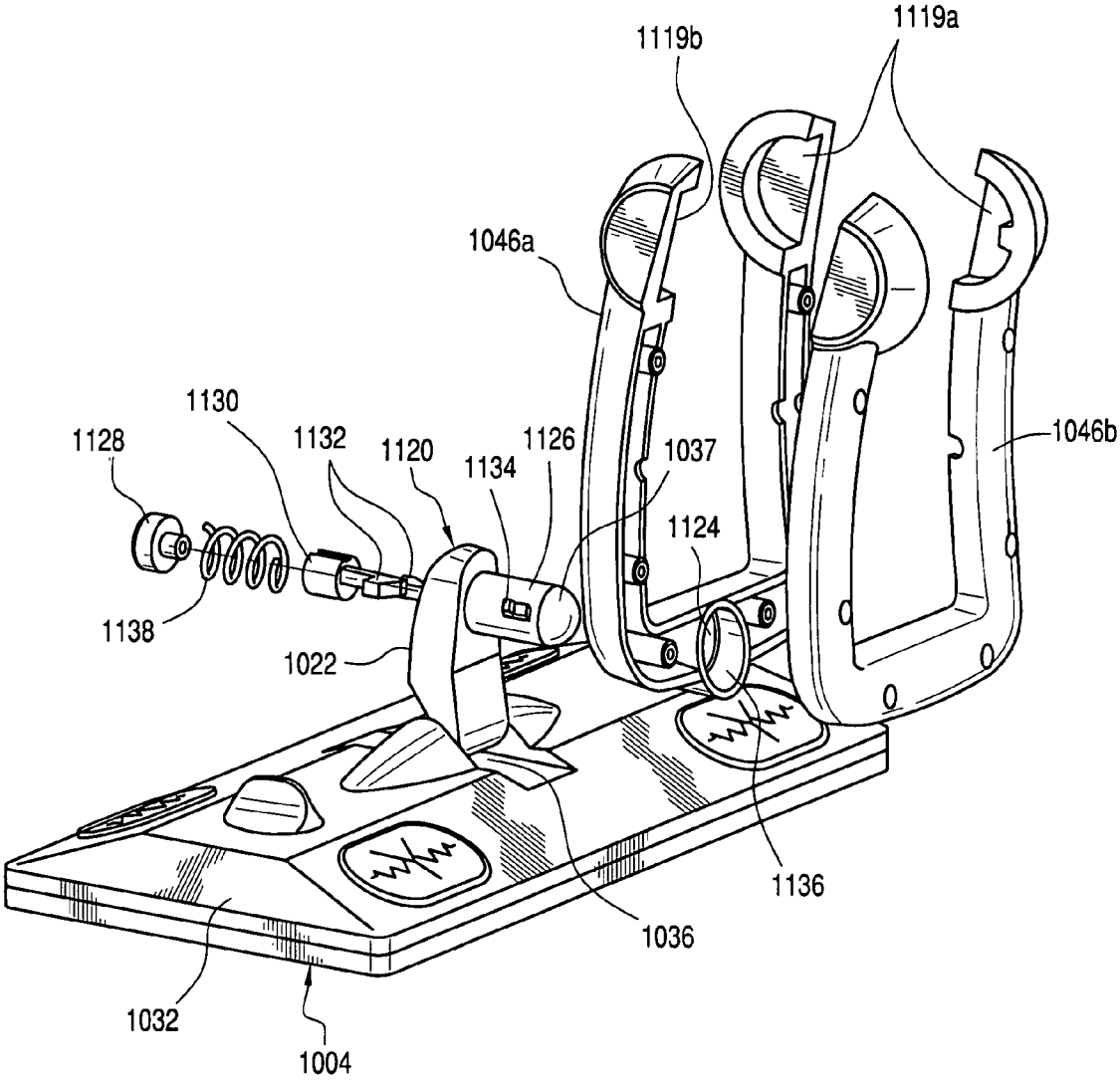
FIG. 27 is a perspective view of the mop head of FIG. 21 showing connection to a collar member about a pivot joint member.

FIG. 27 is a perspective view of mop head 1004 showing connection to collar member 1046 about pivot joint member 1120. As illustrated, collar member 1046 is preferably formed from a pair of matable sections 1046*a*, 1046*b*. Pivot joint member 1120 is a part of mop head 1004 and rotates about pivot joint 1036. In particular, pivot joint member 1120 rotates frontwardly and backwardly with respect to mopping platform 1032. Pivot joint member 1120 includes base section 1022 that rotates about a retaining pin (shown in FIG. 28) in mopping platform 1032. According to an alternate embodiment, pivot joint 1036 is a universal joint.

Pivot joint member 1120 is configured to rotate about and removably engage with collar socket 1124. When mopping platform 1032 is removed from connection with collar member 1046, cleaning tool 1000 may be used as a handled scrubbing tool. Further, by removing mopping platform 1032 from collar member 1046, another mopping platform may be connected to collar member 1046. For example, a scrubbing style mopping platform or another mopping platform having a new mopping cloth may be quickly inserted so that the operator may continue with a mopping operation.

Pivot joint member 1120 has a stator section 1126 that protrudes rearwardly for engaging collar socket 1124. Retaining member 1130 is disposed within a tunnel within stator section 1126 and is urged frontwardly by way of return spring 1138. Retaining member 1130 includes a pair of flexible angled pawls 1132 that protrude outwardly from pawl indentions 1134 in stator section 1126 to engage an interior groove 1136 within collar socket 1124. Button 1128 is configured to be attached to the front side of retaining member 1130 for disengaging pawls 1132 from engagement with interior groove 1136 of collar socket 1124. Return spring 1138 urges retaining member 1130 frontwardly such that flexible pawls 1132 are urged outwardly from indentions 1134 to engage collar socket 1124. When button 1128 is pushed inwardly, the angled pawls 1132 are pushed rearwardly and thereby release from engagement within interior groove 1136. At this time, stator section 1126 may be removed from collar member 1046.

Figure 28:
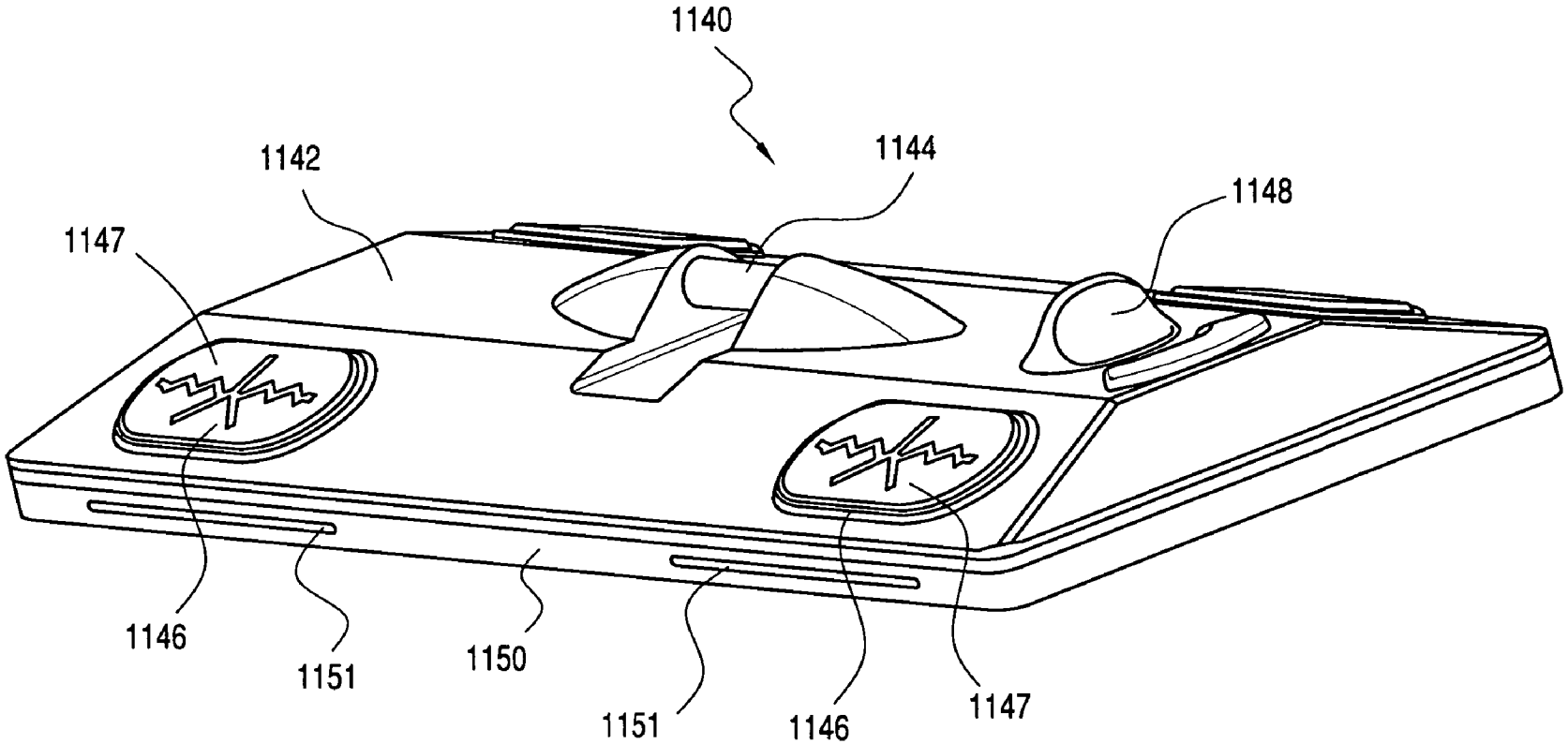
FIG. 28 is an elevated perspective view of a mopping platform according to an embodiment of the present invention.

FIG. 28 is an elevated perspective view of a mopping platform 1140 according to an embodiment of the present invention. Mopping platform 1140 includes a top section 1142 supporting retaining pin 1144. As set forth above, retaining pin 1144 is configured to engage with pivot joint member 1120 (shown in FIG. 27). Top section 1142 includes a plurality of attachment sections 1146. Preferably, attachment sections 1146 are ovulate orifices 1146 defined in top section 1142, with each orifice exposing a plurality of finger members 1147 for removably engaging a cleaning member, such as mopping cloth 260 of FIG. 6. According to an alternate embodiment, attachment sections 1146 are formed from spring loaded metal or plastic alligator clips. According to another alternate embodiment, attachment sections 1146 are removed and an absorbent mopping cloth material is affixed to the flat underside of mop head 1004, such as by way of hook and loop type fasteners or an adhesive. According to yet another embodiment, mop head 1004 is configured to engage a mopping cartridge, as set forth in greater detail below.

In accordance with the embodiment of FIG. 28, an ejector knob 1148 is provided on the top section 1142 for ejecting a cleaning member upon manual rotation thereof. According to an embodiment, ejector knob 1148 ejects a mopping cloth held by attachment sections 1146, as set forth in greater detail below. According to another embodiment, ejector knob 1148 ejects a mopping cartridge, as set forth in greater detail below. Mopping platform 1140 is preferably formed by combining top section 1142 with bottom section 1150. Bottom section 1150 includes sidewall retaining sections 1151 for releasably engaging a mop cartridge. Sidewall retaining sections 1151 are elongated protrusions or indentions in bottom section 1150 that correspond to elongated indentions or protrusions in a corresponding mop cartridge. Accordingly, mopping platform 1140 may optionally support different cleaning elements, such as a mopping cloth supported by attachment sections 1146, or a mopping cartridge supported in part by sidewall retaining sections 1151.

Figure 29:
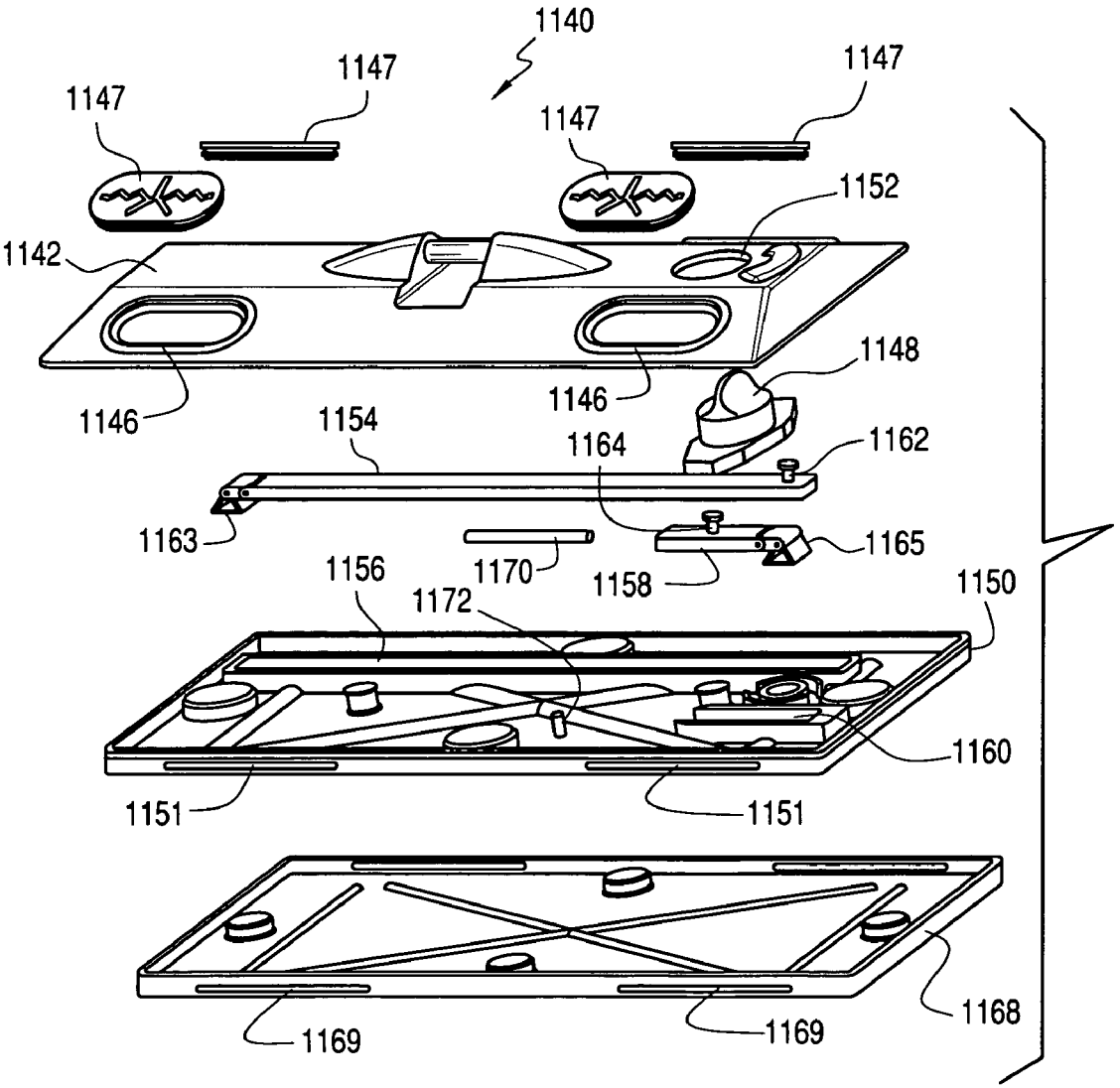
FIG. 29 is an exploded perspective view of the mopping platform of FIG. 28.

FIG. 29 is an exploded perspective view of mopping platform 1140 of FIG. 28. Mopping platform 1140 includes top section 1142 and bottom section 1150 that are fixed together by fastening members, a bonding agent such as glue or adhesive, or a combination thereof. Top section 1142 and bottom section 1150 are preferably fixed together by way of fastening members, such as screws or rivets (not shown). Ejector knob 1148 protrudes through ejector hole 1152 in top section 1142. First ejector bar 1154 is slidably retained within first groove 1156 in bottom section 1150 and second ejector bar 1158 is slidably retained within second groove 1160 in bottom section 1150. First ejector bar 1154 includes pivot extension 1162 and angled ejection member 1163. Likewise, second ejector bar 1158 includes pivot extension 1164 and angled ejection member 1165.

The pivot extensions 1162 and 1164 pivotally engage with ejector knob 1148. As ejector knob 1148 is rotated counterclockwise, first ejector bar 1154 is moved leftwardly to urge angled ejection member 1163 downwardly through an office (not shown) within first groove 1156. Likewise, second ejector bar 1158 is moved rightwardly to urge angled ejection member 1165 downwardly through an office (not shown) within second groove 1160. As the angled ejection members 1163, 1165 protrude downwardly out of bottom section 1150, the members engage and eject cartridge 1168 from mopping platform 1140. Return spring 1170 is connected between second ejection bar 1158 and spring support 1172. Return spring 1170 urges second ejection bar 1158 leftwardly, which thereby urges ejector knob clockwise and returns angled ejection member 1163, 1165 to a position within bottom section 1150. Bottom section 1150 includes a plurality of sidewall retaining sections 1151 that are configured to engage corresponding cartridge retaining sections 1169 in cartridge 1168. Additional corresponding protrusions and indentions are described in greater detail with regard to mop head 800 described above and illustrated in FIGS. 16 and 17.

According to an embodiment, cartridge 1168 is a molded plastic member supporting a permanently bonded mopping cloth. According to an alternate embodiment, cartridge 1168 is a molded plastic member without a bonded mopping cloth such that the mopping cloth is held to mopping platform 1140 by way of finger members 1147. In this embodiment, cartridge 1168 functions as a removable platen for supporting the mopping cloth. The platen may be replaced if worn to thereby extend the useful life of the associated cleaning tool.

Figure 30:
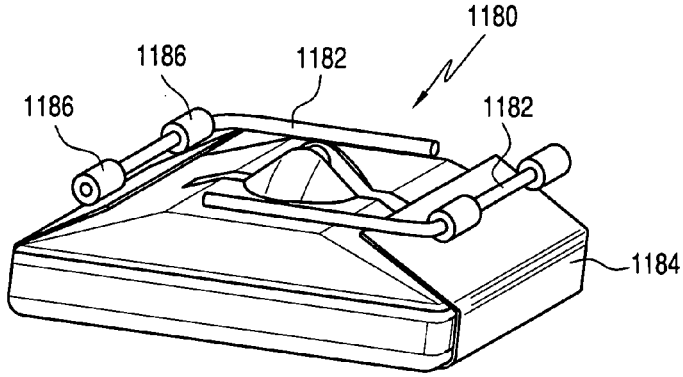
FIGS. 30 and 31 are elevated perspective views of a mopping platform according to an alternate embodiment of the present invention.
Figure 31:
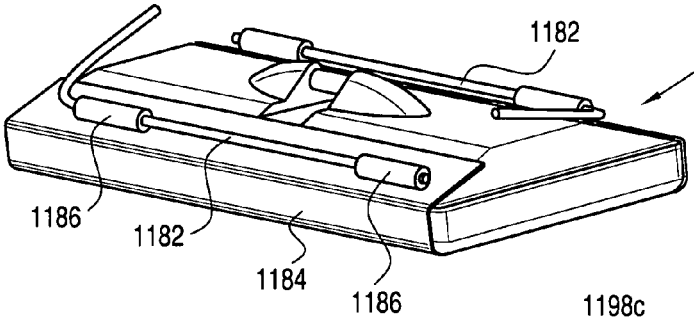

FIGS. 30 and 31 are elevated perspective views of a mopping platform 1180 according to an alternate embodiment of the present invention. As illustrated, platform 1180 includes a pair of rotatable retaining members 1182 for releasably retaining mopping cloth 1184 to platform 1180. Connection of retaining members 1182 to a supporting structure has been removed for clarity. Each retaining member 1182 includes a pair of collar members 1186 for directly engaging mopping cloth 1184. Each retaining member 1182 pivots to release mopping cloth 1184. Each retaining member 1182 flexibly deforms to engage mopping cloth 1184 and clips into a corresponding protrusion from platform 1180 to thereby secure mopping cloth 1184.

Figure 32:
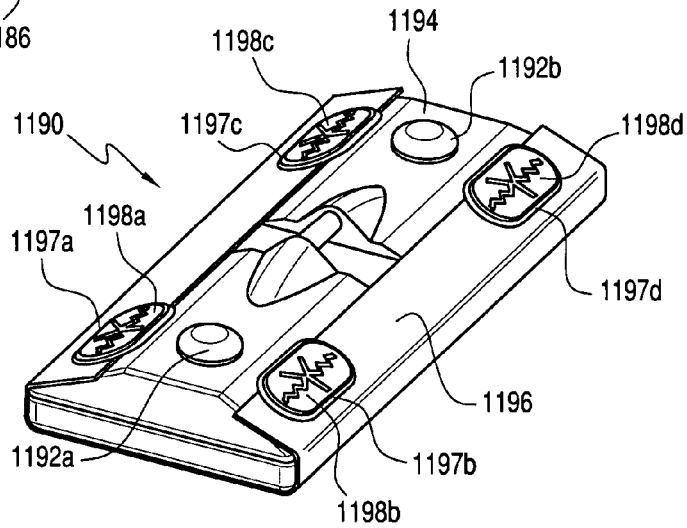
FIGS. 32 and 33 are elevated perspective views of a mopping platform according to another alternate embodiment of the present invention.
Figure 33:
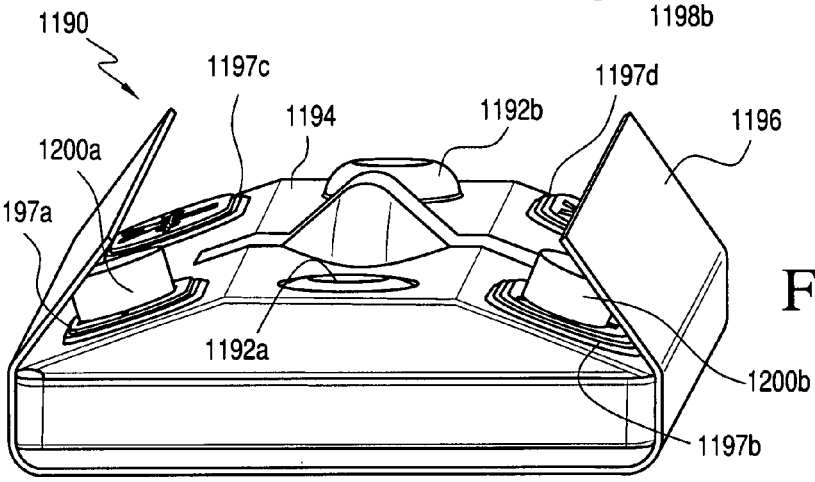

FIGS. 32 and 33 are elevated perspective views of a mopping platform 1190 according to an alternate embodiment of the present invention. Mopping cloth 1196 is retained to mopping platform 1190 by attachment sections 1197*a-d* including corresponding fingers 1198*a-d* as described more fully above. As illustrated, a pair of ejector knobs 1192*a*, 1192*b* are normally disposed above top section 1194, and urged upwardly by way of a spring mechanism (not shown). As particularly illustrated in FIG. 33, when ejector knob 1192*a* is depressed, a mechanical linkage (not shown) urges ejection members 1200*a*, 1200*b* upwardly from attachment sections 1197*a*, 1197*b* to thereby eject mopping cloth 1196 from platform 1190.

Likewise, when ejector knob 1192*b* is depressed, a mechanical linkage (not shown) urges another pair of ejection members upwardly through attachment sections 1197*c*, 1197*d* to thereby eject mopping cloth 1196 from platform 1190. According to an alternate embodiment, ejector knobs 1192*a*, 1192*b* are biased rotatable knobs connected to corresponding ejection members by way of a biased mechanical linkage (not shown). The ejector knobs 1192*a*, 1192*b* rotate to thereby urge the corresponding ejection members through corresponding attachment sections. A spring mechanism urges the ejector knobs 1192*a*, 1192*b* to the return position. According to a preferred embodiment, a single rotatable knob, such as rotatable knob 1192*a* is connected to all ejection members by way of a mechanical linkage (not shown). Thus, when the single rotatable knob is rotated, all ejection members protrude through all attachment sections 1197*a-d* to thereby eject the mopping cloth therefrom. Preferably, a spring mechanism urges the ejection members to return within the top surface 1194 and urges the return of the single rotatable knob to the return position.

FIG. 34 is an elevated perspective view of a mopping platform 1210 according to an alternate embodiment of the present invention. Mopping platform 1210 includes a roller retainer 1212 in the form of a roller member disposed within an elongated groove 1214 in top section 1216. A rotatable wheel 1218 is connected to roller member 1212 by way of a mechanical linkage (not shown). As rotatable wheel 1218 is turned, an edge of a mopping cloth, such as mopping cloth 260 of FIG. 6, is retained by way of friction engagement. To release the mopping cloth, the rotatable wheel 1218 is turned on the reverse direction. According to an embodiment, the roller retainer 1212 includes a roller member in friction engagement with a fixed platen to secure the mopping cloth. According to an alternate embodiment, roller retainer 1212 is a pair of cooperating roller members that are attached to rotatable wheel 1218 by way of a mechanical linkage (not shown) and rotate to retain the mopping cloth. According to the illustrated embodiment, the mopping cloth may be configured such that both ends are retained by way of roller retainer 1212. Preferably, a roller retainer is disposed on alternate sides of mopping platform 1210 for engaging respective ends of a mopping cloth.

FIGS. 35 and 36 are elevated perspective views of a mopping platform 1220 according to an alternate embodiment of the present invention. As illustrated, platform 1220 includes a pair of hinged shutters 1222*a*, 1222*b* for releasably engaging a mopping cloth, such as mopping cloth 260 of FIG. 6. Preferably, each shutter 122*a*, 122*b* is an elongated shutter disposed on a top section 1224 of mopping platform 1220. Each shutter 1222*a*, 1222*b* includes a corresponding handle section 1226*a*, 1226*b* for manual engaging the respective shutter by an operator. As illustrated in FIG. 36, a tension member 1228*a* corresponding to shutter 1222*a* urges shutter 1222*a* into the closed position. A similar tension member (not shown) urges shutter 1222*b* into the closed position. Preferably, shutters 1222*a*, 1222*b* each include corresponding flexibly deformable gripper sections 1230*a*, 1230*b* for securably engaging a corresponding edge of a mopping cloth.

Figure 37:
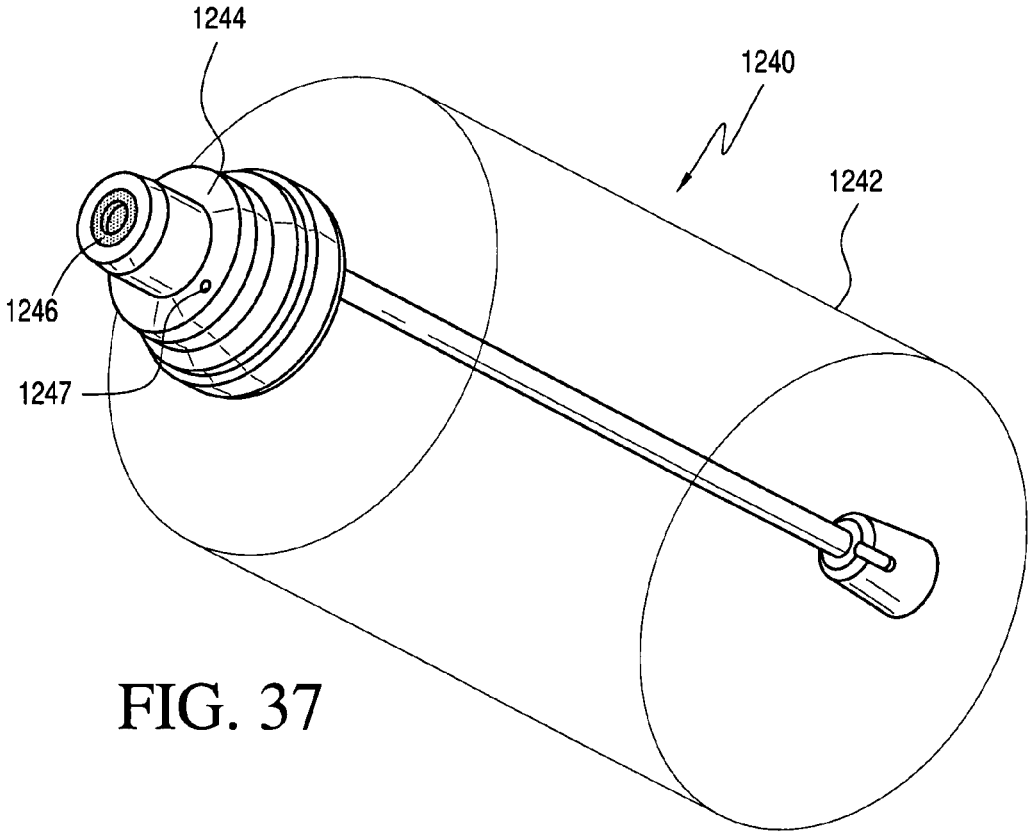
FIG. 37 is an elevated perspective view of a liquid reservoir for use with the present invention.

FIG. 37 is an elevated perspective view of a liquid reservoir 1240 for use with the present invention. Liquid reservoir includes a bottle section 1242 that is threadably engaged with bottle cap 1244. According to a preferred embodiment, liquid reservoir 1240 is configured to be removably received within a cradle of a cleaning tool as set forth above. Bottle cap 1244 is preferably a molded plastic section having a detentable nipple 1246. When liquid reservoir 1240 is not engaged within a cradle of a cleaning tool, reservoir 1240 may be tipped upside down without leaking the liquid retained therein. However, when liquid reservoir 1240 is inserted into a cradle, a reservoir nipple within the cradle engages detentable nipple 1246 such that liquid is permitted to flow through bottle cap 1244 and into the cleaning tool. Bottle cap 1244 includes an air vent 1247 that cooperates with detentable nipple 1246 to supply air into a distal end of bottle section 1242 during fluid egress therefrom. Air vent 1247 retards formation of a vacuum condition within bottle section 1242 and thereby enables a steady flow of liquid from bottle section 1242.

Figure 38:
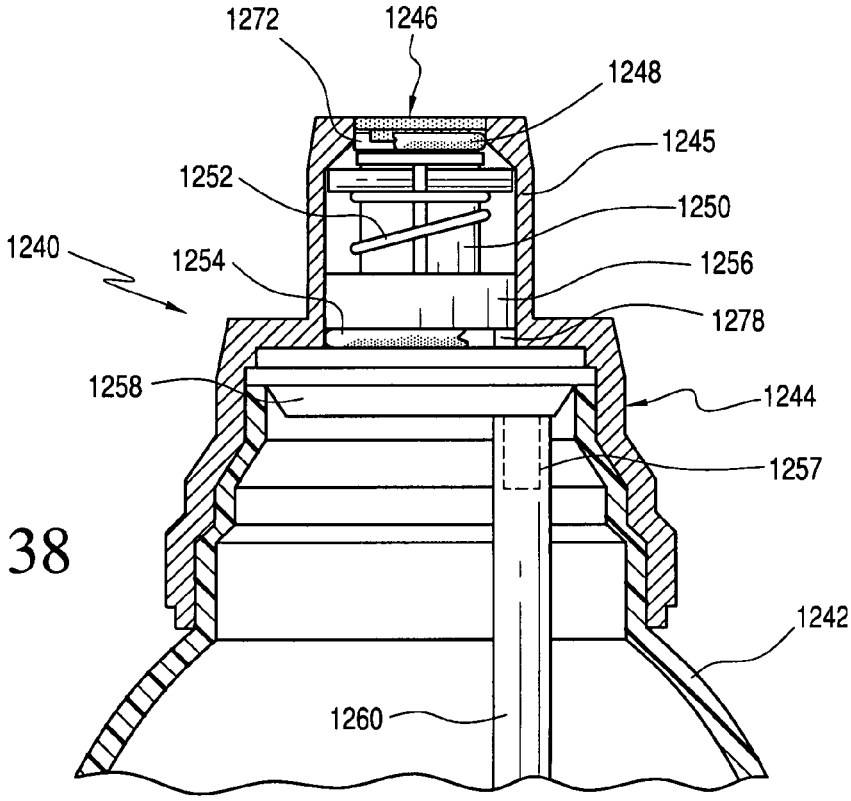
FIG. 38 is a sectional view of a bottle cap for the liquid reservoir of FIG. 37.
Figure 39:
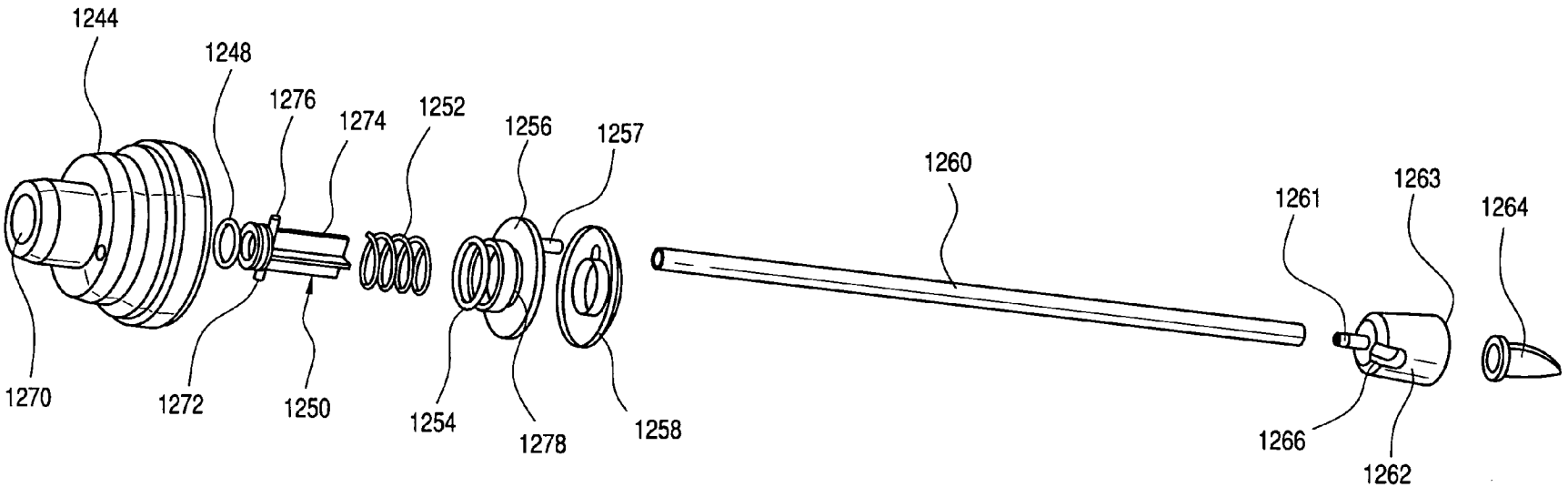
FIG. 39 is an exploded perspective view of interior components of the liquid reservoir of FIG. 37.

FIG. 38 is a sectional view of bottle cap 1244 of FIG. 37. FIG. 39 is an exploded perspective view of the interior components of liquid reservoir 1240 of FIG. 37. Bottle cap 1244 includes an outer cap housing 1245 defining interior threads for threadably engaging corresponding threads in the top of bottle section 1242. Cap housing 1245 retains therein the detentable nipple 1246. The detentable nipple 1246 is formed through a combination of plunger 1250, retaining member 1256, and cap spring 1252. Plunger 1250 travels through tubular passage 1270 within bottle cap 1244. Plunger 1250 includes a peripheral groove 1272 in a head section thereof for supporting O-ring 1248. When plunger 1250 is in the closed position within tubular passage 1270, O-ring 1248 maintains a seal with tubular passage. When plunger 1250 is in the open position, liquid from bottle section 1242 passes around the flutes in plunger 1250 and out through tubular passage 1270.

A cap spring 1252 contacts extension arms 1276 of plunger 1250 and a flat surface of retaining member 1256 to urge plunger 1250 into the closed position. Retaining member 1256 includes an annular groove for retaining O-ring 1254 therein. When retaining member 1256 is press fit against an interior sidewall of cap housing 1245, O-ring 1254 maintains a seal with the interior sidewall. Locking member 1258 is press fit within an interior groove in the interior sidewall of cap housing 1245 to secure retaining member 1256 into position. Retaining member 1256 includes a tubular extension 1257 that mates with tubing section 1260 to provide an air passage above retaining member 1256. Tubing section 1260 is preferably semi-rigid and extends toward the end of bottle section 1242 to maintain positive air pressure during egress of liquid from bottle section 1242. Tubing section 1260 mates at a distal end with tubular extension 1261 of tube holder 1262. Air directing valve 1264 is retained within tube holder 1262 and is a one-way valve to direct air flow outwardly through the open bottom section 1263 and out through holes 1266 in the side wall of tube holder 1262. Air directing valve 1264 prevents egress of liquid from bottle section 1242 from entering tubing section 1260. Air directing valve 1264 further serves to prevent blockage of tubing section 1260 should dirt or contaminants enter bottle section 1242.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

We claim:

1. A cleaning tool, comprising:

a handle assembly including a power head connected at a distal end of the handle assembly, the power head having an electric motor that drives an attached scrub head; and a mop head pivotally connected to the handle assembly so that it rotates about the power head, wherein the mop head can be pivotally moved between a first position extending beyond the scrub head to cover the scrub head and a second position retracted towards the handle assembly to expose the scrub head.

2. The cleaning tool according to claim 1, wherein the power head comprises a motor to induce agitation in the scrub head in response to transmission of power from a power supply.

3. The cleaning tool according to claim 2, wherein the power supply further comprises at least one battery internally disposed within a housing of the power head.

4. The cleaning tool according to claim 1, further comprising:

a nozzle assembly connected to said handle assembly and in fluid communication with a liquid reservoir, wherein liquid disposed within the liquid reservoir is ejected from the nozzle assembly in response to trigger control by an operator.

5. The cleaning tool according to claim 4, wherein the liquid reservoir is removably retained within a caddy connected to the extension member, and a fluid line, at least partially disposed within the extension member connects the nozzle assembly to the liquid reservoir.

6. The cleaning tool according to claim 1, further comprising:

a pivot handle slidably attached to the handle assembly and connected to the mop head, wherein the pivot handle is pulled rearwardly to pivot the mop head to expose the power head.

7. The cleaning tool according to claim 1, said mop head further comprising:

a mopping platform having a flat lower surface and at least one attachment section for retaining a mopping cloth.

8. The cleaning tool according to claim 7, wherein the mopping platform has a plurality of the attachment sections, each of said attachment sections including a plurality of flexibly deformable fingers for securably retaining the mopping cloth by way of manual insertion therein.

9. A cleaning tool, comprising:

a handle assembly including a motorized power head connected at a distal end of the handle assembly, the power head having an electric motor to induce agitation in an attached scrub head; and a mop head pivotally connected to the handle assembly so that it rotates about the power head, wherein the mop head pivotally moves between an extended position extending beyond the scrub head that covers the scrub head and a retracted position retracted towards the handle assembly that exposes the scrub head in a scrubbing position.

10. The cleaning tool according to claim 9, further comprising a nozzle assembly connected to the handle assembly and in fluid communication with a liquid reservoir, wherein liquid disposed within the liquid reservoir is ejected from the nozzle assembly in response to trigger control by an operator, the liquid reservoir is removably retained within a caddy attached to the extension member, and a fluid line, at least partially disposed within the extension member, connects the nozzle assembly to the liquid reservoir.

11. The cleaning tool according to claim 9, further comprising:

a pivot handle connected to the mop head, wherein the pivot handle is manipulated to pivotally retract the mop head with respect to the power head.

12. The cleaning tool according to claim 9, said mop head further comprising:

a mopping platform having a plurality of mopping cloth attachment sections disposed on a top surface thereof for retaining a mopping cloth.

* * * * *